US011389011B2

(12) United States Patent
Gibbons

(10) Patent No.: US 11,389,011 B2
(45) **Date of Patent: *Jul. 19, 2022**

(54) NEWBORN CARRIER

(71) Applicant: The Boppy Company, LLC, Golden, CO (US)

(72) Inventor: Haley Gibbons, Westminster, CO (US)

(73) Assignee: The Boppy Company, LLC, Golden, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/103,166

(22) Filed: Nov. 24, 2020

(65) Prior Publication Data

US 2021/0076844 A1 Mar. 18, 2021

Related U.S. Application Data

(63) Continuation-in-part of application No. 16/722,675, filed on Dec. 20, 2019, now Pat. No. 11,185,173, (Continued)

(51) Int. Cl.
*A47D 13/02* (2006.01)

(52) U.S. Cl.
CPC ..... *A47D 13/025* (2013.01)

(58) Field of Classification Search
CPC ..... A61G 1/00; A45F 3/04; A45F 3/14; A45F 3/08; A47D 13/025; A47D 13/02; A41D 1/215
See application file for complete search history.

(56) References Cited

U.S. PATENT DOCUMENTS 3,871,562 A 3/1975 Grenier
4,009,808 A 3/1977 Sharp
(Continued)

FOREIGN PATENT DOCUMENTS

AU 2008249011 11/2008
CA 2685364 12/2014
(Continued)

OTHER PUBLICATIONS

U.S. Appl. No. 16/722,675, Non-Final Rejection dated Jul. 29, 2021, all pages.
(Continued)

*Primary Examiner* — Brian D Nash
(74) *Attorney, Agent, or Firm* — Kilpatrick Townsend & Stockton LLP

(57) ABSTRACT

A baby carrier capable of carrying an infant. The baby carrier includes a belt that wraps around a caregiver's waist. A baby support portion couples to the belt and supports the infant. A first tie strap couples to the baby support portion The first tie strap defines an opening through which an arm of the caregiver passes when wearing the baby carrier. The first tie secures the baby carrier around the torso of the caregiver with the arm of the caregiver through the opening in the first tie such that the first tie rests on the shoulder of the caregiver at the opening. A second tie couples to the baby support portion and includes a second opening similar to the opening in the first tie. The first and second ties are secured to the baby support portion enabling adjustment and securing of the baby carrier to the caregiver.

15 Claims, 25 Drawing Sheets

Related U.S. Application Data which is a continuation of application No. 16/235,428, filed on Dec. 28, 2018, now Pat. No. 10,555,620, which is a continuation-in-part of application No. 15/430,230, filed on Feb. 10, 2017, now Pat. No. 10,264,894.

(56) References Cited

U.S. PATENT DOCUMENTS 4,166,558 A 9/1979 Schroeder
D266,800 S 11/1982 Kula et al.
4,428,514 A 1/1984 Elf
4,434,920 A 3/1984 Moore
4,469,259 A 9/1984 Krich et al.
4,492,326 A 1/1985 Storm
4,986,458 A 1/1991 Linday
5,071,047 A 12/1991 Cordisco
5,205,451 A 4/1993 Manzer
5,246,152 A 9/1993 Dotseth
5,490,620 A 2/1996 Bergqvist
5,632,425 A 5/1997 Hull
5,678,739 A 10/1997 Darling et al.
5,692,655 A 12/1997 Fair et al.
5,791,535 A 8/1998 Roan et al.
5,813,580 A 9/1998 Fair
5,848,741 A 12/1998 Fair
5,950,887 A 9/1999 Powell
5,961,014 A 10/1999 Knerr
6,045,018 A 4/2000 Onishi
6,065,655 A 5/2000 Parewick
6,112,960 A 9/2000 Seering et al.
6,257,468 B1 7/2001 Yamazoe et al.
D452,993 S 1/2002 Norman
6,409,060 B2 6/2002 Donine
6,443,339 B1 9/2002 Higuchi
6,598,771 B2 7/2003 Norman
6,666,361 B1 12/2003 Lin
D486,635 S 2/2004 Yagisawa
6,808,099 B2 10/2004 Nykoluk
6,988,644 B1 1/2006 Asherbranner
7,004,362 B2 2/2006 Boone
7,070,076 B2 7/2006 Bergkvist
7,252,214 B2 8/2007 Krogh
7,287,676 B2 10/2007 Chua
7,322,498 B2 1/2008 Frost
7,494,031 B2 2/2009 Kassai et al.
7,661,566 B2 2/2010 Yoshie et al.
D614,861 S 5/2010 Smyth et al.
7,766,199 B1 8/2010 Caperon
D630,838 S 1/2011 Gmeiner et al.
7,886,946 B2 2/2011 Gray
D642,375 S 8/2011 Zack et al.
D649,345 S 11/2011 Bergkvist et al.
8,056,779 B1 11/2011 Brunwin
D657,132 S 4/2012 Caperon
8,172,116 B1 * 5/2012 Lehan ..... A47D 13/025 224/160
D672,546 S 12/2012 Dror et al.
8,393,505 B2 3/2013 Coote
8,403,193 B2 3/2013 Chan
8,418,897 B1 4/2013 Young
8,424,732 B1 4/2013 Lehan et al.
8,453,894 B2 6/2013 Jung et al.
8,453,897 B2 6/2013 Burton
8,464,920 B2 6/2013 Meyer
8,490,844 B2 7/2013 Favorito et al.
8,523,028 B1 9/2013 Young
D691,791 S 10/2013 Rondone
8,579,168 B2 11/2013 Zack et al.
8,590,757 B2 11/2013 Frost
8,701,949 B1 4/2014 Lehan et al.
8,752,739 B2 6/2014 Bergkvist et al.
8,807,411 B2 8/2014 Meyer
8,925,772 B2 * 1/2015 Vukovics ..... A47D 13/025 224/160
8,973,793 B2 3/2015 Arvan
8,973,794 B2 3/2015 Bergkvist et al.
9,022,260 B2 5/2015 Frost
D738,614 S 9/2015 Chapman
D738,615 S * 9/2015 Chapman ..... D3/214
9,119,423 B2 9/2015 Gotel et al.
9,138,071 B2 9/2015 Larch
9,173,473 B2 11/2015 Gleason
9,179,758 B2 * 11/2015 Calilung ..... A47D 13/025
9,185,993 B2 11/2015 Telford et al.
9,198,525 B2 12/2015 Wernick et al.
9,220,352 B2 12/2015 Frost
9,277,830 B2 3/2016 Schachtner
D752,855 S 4/2016 Halverstadt et al.
9,314,111 B2 4/2016 Hartwell et al.
9,314,112 B2 4/2016 Chuah
9,314,113 B1 4/2016 Lehan
9,357,852 B2 6/2016 Salazar et al.
9,375,096 B2 6/2016 Larch
9,380,886 B2 * 7/2016 Rahni ..... A47D 13/02
9,380,887 B2 7/2016 Frost
9,380,888 B2 7/2016 Telford et al.
9,386,863 B1 7/2016 Antunovic
9,439,515 B2 9/2016 Kim
9,521,912 B2 12/2016 Yen
D775,815 S 1/2017 Halverstadt et al.
9,565,951 B2 2/2017 Schaarschmidt
9,629,398 B2 4/2017 Goryl
9,681,737 B2 6/2017 Gleason
9,700,152 B2 7/2017 Telford et al.
9,713,391 B2 7/2017 Telford et al.
9,750,352 B2 9/2017 Harris
9,750,353 B2 9/2017 Antunovic
9,788,664 B2 10/2017 Andren et al.
9,839,302 B2 12/2017 Frost
9,848,713 B2 12/2017 Rosen et al.
9,877,596 B2 1/2018 Schaarschmidt
9,949,575 B2 4/2018 Pond et al.
9,955,797 B2 5/2018 Telford et al.
10,045,634 B2 8/2018 Salazar et al.
10,172,478 B2 1/2019 Telford et al.
D844,973 S 4/2019 Gibbons
10,264,894 B2 4/2019 Gibbons
10,300,327 B2 5/2019 Donchenko et al.
10,555,620 B2 2/2020 Gibbons
D882,244 S 4/2020 Gibbons
2002/0175194 A1 * 11/2002 Norman ..... A47D 13/025 224/160
2003/0178452 A1 9/2003 Norman
2005/0051582 A1 * 3/2005 Frost ..... A47D 13/025 224/160
2005/0077330 A1 4/2005 Fernandez
2005/0133551 A1 6/2005 Heidt
2005/0242136 A1 11/2005 Moriguchi et al.
2005/0279785 A1 12/2005 Liistro et al.
2006/0237493 A1 10/2006 Tsai
2007/0029356 A1 2/2007 Moriguchi et al.
2007/0062987 A1 3/2007 Murakami
2007/0062988 A1 3/2007 Kassai et al.
2007/0062989 A1 3/2007 Kassai et al.
2007/0080183 A1 4/2007 Lafoux et al.
2007/0284403 A1 12/2007 Minami et al.
2008/0283559 A1 11/2008 Parness et al.
2009/0026235 A1 1/2009 Gray
2009/0206116 A1 * 8/2009 Grant ..... A47D 13/025 224/160
2010/0200626 A1 8/2010 Moftakhar
2010/0308088 A1 12/2010 Lindblom
2011/0101051 A1 5/2011 Parness et al.
2011/0240693 A1 10/2011 Parness et al.
2012/0152987 A1 6/2012 Beltrame et al.
2012/0199619 A1 8/2012 Zack
2012/0234877 A1 9/2012 Hiniduma-Lokuge
2012/0241487 A1 9/2012 Zack et al.
2012/0248159 A1 10/2012 Rahni
2012/0266350 A1 10/2012 Zack
2012/0286002 A1 11/2012 Dardel et al.
2013/0200116 A1 8/2013 Arvan
2014/0084031 A1 3/2014 Bowden

(56) References Cited

U.S. PATENT DOCUMENTS

| | | | | |
|---|---|---|---|---|
| 2014/0166705 | A1 | 6/2014 | Vukovics | |
| 2014/0231473 | A1 | 8/2014 | Bailey et al. | |
| 2014/0263492 | A1 | 9/2014 | Bailey | |
| 2014/0284362 | A1 | 9/2014 | Halverstadt et al. | |
| 2014/0319189 | A1* | 10/2014 | Hoppener-Visser | A47D 13/02 224/160 |
| 2015/0189997 | A1 | 7/2015 | Gmeiner | |
| 2015/0196133 | A1 | 7/2015 | Rosen et al. | |
| 2015/0201761 | A1 | 7/2015 | Wollenberg | |
| 2015/0272342 | A1 | 10/2015 | Schaarschmidt | |
| 2016/0066704 | A1 | 3/2016 | Frost | |
| 2016/0120334 | A1 | 5/2016 | Pond et al. | |
| 2016/0150893 | A1* | 6/2016 | Salazar | A47D 13/025 224/160 |
| 2016/0198865 | A1 | 7/2016 | Houston | |
| 2016/0206011 | A1* | 7/2016 | Houston | A47D 13/025 |
| 2016/0206115 | A1 | 7/2016 | Brake et al. | |
| 2016/0227847 | A1 | 8/2016 | Gibbons | |
| 2016/0227940 | A1 | 8/2016 | Wikner et al. | |
| 2016/0278537 | A1 | 9/2016 | Frost | |
| 2017/0119173 | A1 | 5/2017 | Telford | |
| 2017/0135497 | A1 | 5/2017 | Brodin | |
| 2017/0150826 | A1 | 6/2017 | Salazar et al. | |
| 2017/0196374 | A1 | 7/2017 | Chen | |
| 2017/0238682 | A1 | 8/2017 | Goryl | |
| 2017/0238722 | A1 | 8/2017 | Flaunty et al. | |
| 2017/0251829 | A1 | 9/2017 | Telford et al. | |
| 2017/0332806 | A1 | 11/2017 | Liu | |
| 2017/0332807 | A1 | 11/2017 | Liu | |
| 2018/0116426 | A1 | 5/2018 | Telford | |
| 2018/0228299 | A1 | 8/2018 | Gibbons | |
| 2018/0228301 | A1 | 8/2018 | Winfield Kmiec | |
| 2018/0263857 | A1 | 9/2018 | Gibbons et al. | |
| 2019/0014920 | A1 | 1/2019 | Matsuyama | |
| 2019/0075936 | A1* | 3/2019 | Salazar | A45F 3/047 |
| 2019/0133339 | A1 | 5/2019 | Gibbons | |
| 2019/0261703 | A1 | 8/2019 | Zodel et al. | |
| 2020/0060434 | A1 | 2/2020 | Caron et al. | |
| 2020/0146464 | A1 | 5/2020 | Manouchehri et al. | |
| 2020/0221885 | A1 | 7/2020 | Gibbons | |
| 2021/0076844 | A1 | 3/2021 | Gibbons | |

FOREIGN PATENT DOCUMENTS

| | | |
|---|---|---|
| CN | 204 363 532 U | 6/2015 |
| DE | 202014002721 | 7/2014 |
| DE | 112010003056 | 8/2018 |
| EP | 1907259 | 4/2008 |
| EP | 2194817 | 6/2010 |
| EP | 1765123 | 6/2011 |
| EP | 2421413 | 2/2012 |
| EP | 2470050 | 3/2014 |
| EP | 2810587 | 12/2014 |
| EP | 3366162 | 8/2018 |
| ES | 2540812 | 7/2015 |
| GB | 2297915 | 8/1996 |
| WO | 2005025383 | 6/2005 |
| WO | 2011011158 | 3/2011 |
| WO | 2013188810 | 12/2013 |
| WO | 2014160355 | 10/2014 |
| WO | 2014160355 | 11/2014 |
| WO | 2016039635 | 3/2016 |
| WO | 2016161111 | 10/2016 |
| WO | 2016164713 | 10/2016 |
| WO | 2017075500 | 5/2017 |
| WO | 2018033351 | 2/2018 |
| WO | 2018081603 | 5/2018 |

OTHER PUBLICATIONS

U.S. Appl. No. 15/430,230 , Non-Final Office Action, dated Aug. 28, 2018, 10 pages.
U.S. Appl. No. 15/430,230 , Notice of Allowance, dated Jan. 24, 2019, 10 pages.
U.S. Appl. No. 16/235,428 , Non-Final Office Action, dated Jun. 27, 2019, 9 pages.
U.S. Appl. No. 16/235,428 , Notice of Allowance, Sep. 30, 2019, 6 pages.
U.S. Appl. No. 29/675,152 , Non-Final Office Action, dated Oct. 23, 2019, 8 pages.
U.S. Appl. No. 29/675,152 , Notice of Allowance, dated Feb. 26, 2020, 6 pages.
Boppy , "Power Point", Jan. 1, 2018, 3 pages.
DE700000040011804-0001 , "German Design Application No.", Dec. 27, 2006, 3 pages.
Application No. PCT/US2018/014075 , International Preliminary Report on Patentability, dated Aug. 22, 2019, 10 pages.
Application No. PCT/US2018/014075 , International Search Report and Written Opinion, dated May 28, 2018, 15 pages.
PCT/US2018/014075 , "Invitation to Pay Add'l Fees and Partial Search Rpt", Apr. 4, 2018, 9 pages.
Peter , "Sling for Carrying Babies", Office for Harmonization in the Internal Market, No. 000304514-0001, Mar. 5, 2005, 3 pages.
Peter , "Sling for Carrying Babies", Office for Harmonization in the Internal Market, No. 000304514-0002, Mar. 5, 2005, 3 pages.
Petra , "Baby and Toddler Carrier", OHIM—Office for Harmonization in the Internal Market, No. 000989736-0008, Aug. 21, 2008, 3 pages.
Petra , "Baby and Toddler Carrier", OHIM—Office for Harmonization in the Internal Market, No. 000989736-0009, Aug. 21, 2008, 3 pages.
Petra , "Baby and Toddler Carrier", OHIM—Office for Harmonization in the Internal Market, No. 000989736-0010, Aug. 21, 2008, 3 pages.
Petra , "Baby and Toddler Carrier", OHIM—Office for Harmonization in the Internal Market, No. 000989736-0011, Aug. 21, 2008, 3 pages.
Petra , "Baby and Toddler Carrier", OHIM—Office for Harmonization in the Internal Market, No. 000989736-0012, Aug. 21, 2008, 3 pages.
Petra , "Baby and Toddler Carrier", OHIM—Office for Harmonization in the Internal Market, No. 000989736-0013, Aug. 21, 2008, 3 pages.
Petra , "Baby and Toddler Carrier", OHIM—Office for Harmonization in the Internal Market, No. 000989736-0014, Aug. 21, 2008, 3 pages.
Petra , "Baby and Toddler Carrier", OHIM—Office for Harmonization in the Internal Market, No. 000989736-0015, Aug. 21, 2008, 3 pages.
Petra , "Baby and Toddler Carrier", OHIM—Office for Harmonization in the Internal Market, No. 000989736-0016, Aug. 21, 2008, 3 pages.
Petra , "Baby and Toddler Carrier", OHIM—Office for Harmonization in the Internal Market, No. 000989736-0017, Aug. 21, 2008, 3 pages.
Petra , "Baby and Toddler Carrier", OHIM—Office for Harmonization in the Internal Market, No. 000989736-0018, Aug. 21, 2008, 3 pages.
Petra , "Baby and Toddler Carrier", OHIM—Office for Harmonization in the Internal Market, No. 000989736-0019, Aug. 21, 2008, 3 pages.
Petra , "Baby and Toddler Carrier", OHIM—Office for Harmonization in the Internal Market, No. 000989736-0020, Aug. 21, 2008, 3 pages.
Petra , "Baby and Toddler Carrier", OHIM—Office for Harmonization in the Internal Market, No. 000989736-0021, Aug. 21, 2008, 3 pages.
Petra , "Baby and Toddler Carrier", OHIM—Office for Harmonization in the Internal Market, No. 000989736-0022, Aug. 21, 2008, 3 pages.
Petra , "Baby and Toddler Carrier", OHIM—Office for Harmonization in the Internal Market, No. 000989736-0023, Aug. 21, 2008, 3 pages.

(56) References Cited

OTHER PUBLICATIONS

Petra , "Baby and Toddler Carrier", OHIM—Office for Harmonization in the Internal Market, No. 000989736-0024, Aug. 21, 2008, 3 pages.
Petra , "Baby and Toddler Carrier", OHIM—Office for Harmonization in the Internal Market, No. 000989736-0001, Aug. 21, 2008, 4 pages.
Petra , "Baby and Toddler Carrier", OHIM—Office for Harmonization in the Internal Market, No. 000989736-0003, Aug. 21, 2008, 4 pages.
Petra , "Baby and Toddler Carrier", OHIM—Office for Harmonization in the Internal Market, No. 000989736-0004, Aug. 21, 2008, 4 pages.
Petra , "Baby and Toddler Carrier", OHIM—Office for Harmonization in the Internal Market, No. 000989736-0006, Aug. 21, 2008, 4 pages.
Petra , "Baby and Toddler Carrier", OHIM—Office for Harmonization in the Internal Market, No. 000989736-0002, Aug. 21, 2008, 5 pages.
Petra , "Baby and Toddler Carrier", OHIM—Office for Harmonization in the Internal Market, No. 000989736-0005, Aug. 21, 2008, 5 pages.
Petra , "Baby and Toddler Carrier", OHIM—Office for Harmonization in the Internal Market, No. 000989736-0007, Aug. 21, 2008, 5 pages.
The Boppy Company, "How to Wear Boppy ComfyFit Baby Carrier-Front Facing In, Front Facing Out, Stash & Go," uploaded to YouTube on Feb. 8, 2018, p. 1, XP054980303, Retrieved from the Internet: URL: https://www.youtube.com/watch?v=MCWvdOe8tzw [retrieved on Mar. 13, 2020] the whole document. 19 pages.
International Search Report and Written Opinion for PCT/US2021/058472 dated Feb. 24, 2022, all pages.

* cited by examiner

NEWBORN CARRIER

CROSS-REFERENCE TO RELATED APPLICATIONS

This application is a continuation-in-part of U.S. application Ser. No. 16/722,675, filed Dec. 20, 2019, which is a continuation of U.S. application Ser. No. 16/235,428, filed Dec. 28, 2018, which is a continuation-in-part of U.S. application Ser. No. 15/430,230, filed Feb. 10, 2017, the complete disclosures of which are herein incorporated by reference.

FIELD OF THE INVENTION

The disclosure generally relates to baby carriers.

BACKGROUND OF THE INVENTION

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Babies and toddlers are frequently carried by their mothers and other caregivers before they are able to comfortably walk on their own. Carrying babies enables a caregiver to better monitor and comfort their babies. Unfortunately, carrying a baby around reduces the caregiver's ability to perform other tasks such as shopping and caring for other small children because one or more hands/arms are used to carry the infant. A baby may also exhaust a caregiver when carried for a long time. Baby carriers enable caregivers to carry babies using their torso and shoulders, which frees their hands to perform other tasks. However, existing baby carriers can be difficult to assemble and to adjust. For example, some carriers consist of a single piece of fabric that a caregiver wraps in a complicated manner to secure the infant. Other baby carriers have an excessive number of straps and buckles that need to be individually adjusted for comfort and to secure the infant.

BRIEF SUMMARY OF THE INVENTION

The examples discussed below include a baby carrier capable of carrying an infant. The baby carrier includes a waist belt or belt that wraps around a caregiver's waist. A baby support portion couples to the belt and supports the infant. The baby carrier includes shoulder straps to couple the baby carrier to a caregiver's shoulder. The shoulder straps may be operably connected to the baby support or integrally formed with the baby support. In some instances the shoulder straps may be made of the same continuous materials as the baby support, while in other instances the shoulder straps may be stitched or otherwise permanently connected to the baby support. The shoulder straps each form a loop through which the caregiver's left and right arms pass through and cause the shoulder straps to rest on the caregiver's shoulders. The baby carrier also includes left and right ties, with one end of each connected or sewn to the baby support. In other examples, the ties may be connected or sewn to the belt. In some examples, the ties are coupled to the shoulder straps such that the ties and shoulder straps can each slide relative to one another. The ties are of a length long enough to tie the free ends together and secure the baby carrier to the caregiver.

In an alternative example, the baby carrier includes a first shoulder strap that couples to the baby support portion and is formed of a loop of fabric. The first shoulder strap couples the baby support portion to a caregiver's shoulder. A second shoulder strap is coupled to the baby support portion and is formed of a loop of fabric. The second shoulder strap couples the baby support portion to the caregiver's opposite shoulder. First and second ties are coupled to the respective first and second shoulder straps, facilitating the securement of the baby to the caregiver in an easy and convenient manner.

In still another example, one end of each shoulder strap may be coupled to the baby support at an end opposite the belt. The other end of each shoulder strap may be coupled to a middle of the baby support. The length of the shoulder straps may be adjusted to accommodate different caregiver and/or baby sizes and also functions to adjust the position or fit of the baby carrier on the caregiver. The adjustment mechanism used to adjust the length of the shoulder straps may be located near where the shoulder straps are coupled to the baby support. In this way, the shoulder straps may be loosened or tightened to adjust the fit and position of the baby carrier on the caregiver. In another aspect, the adjustment mechanism may include an adjustable buckle on a nylon strap or may include a series of snaps, buttons, hook and loop fasteners, or other such devices.

In another example, the baby carrier includes a belt that wraps around the caregiver's waist. A baby support portion couples to the belt. A first shoulder strap rests on a caregiver's first shoulder. The first shoulder strap has a first end and a second end. The first end and the second end couple to the baby support portion. A second shoulder strap rests on a caregiver's second shoulder. The second shoulder strap has a first end and a second end. The first end and the second end of the second shoulder strap couple to the baby support portion.

In another example, a method of carrying a baby in a baby carrier is presented. The method includes coupling a belt of the baby carrier around a caregiver's waist. After coupling the belt to the caregiver, the caregiver places a baby in a baby support portion. The caregiver secures the baby in the baby carrier by placing a caregiver's left arm through a first shoulder strap and a right arm through a second shoulder strap. To adjust the baby carrier, the caregiver may pull first and second ties coupled to the respective first and second shoulder straps. The caregiver may then secure the baby carrier in the adjusted position by tying a knot with the first and second ties. In some examples, the method also includes adjusting a tightness or size of the first and second shoulder straps to snugly fit the caregiver's shoulders.

In another example, the baby carrier includes a belt that wraps around the caregiver's waist. The belt is coupled to a baby support portion. The belt is curved on an upper edge to form a larger seat area and to allow for reinforced button holes to couple to the baby support portion or to first and second ties. A first shoulder strap rests on a caregiver's first shoulder. The first shoulder strap has a first end and a second end. The first end and the second end of the first shoulder strap couple to the baby support portion. The second end of the first shoulder strap couples to the baby support portion and has an adjustable strap built in to adjust a fit or tightness of the first shoulder strap on the caregiver's shoulder. A second shoulder strap rests on a caregiver's second shoulder. The second shoulder strap has a first end and a second end.

The first end and the second end of the second shoulder strap couple to the baby support portion. The second end of the second shoulder strap couples to the baby support portion and has an adjustable strap to adjust a fit or tightness of the second shoulder strap on the caregiver's shoulder.

In some examples, a first and a second tie formed of fabric couple to the baby support portion and/or to the belt. In some examples, the first and the second ties couple to both the baby support portion and the belt. The first and the second ties are slidably coupled to the first and the second shoulder straps, respectively. The first and the second ties are long enough to wrap around the caregiver's body, particularly the torso section, and to tie the ends of the first and the second ties together to secure the baby carrier to the caregiver.

In some examples, the first and second ties include buttons near a first end, where the first and second ties are secured to the baby support portion. The buttons are insertable into button holes or openings in the belt to provide a wider or narrower seat width for different configurations of the baby carrier.

In some examples, the baby support portion is attached to the belt to be secured around the caregiver's waist at a lower end and has a headrest at an opposite, upper end. The headrest has, in some examples, flaps on either side with buttons or closures to attach to the first and the second shoulder straps. The headrest secures, in some configurations, the first and the second ties when secured to the first and the second shoulder straps. The headrest has an extended configuration with the headrest extending from the baby support portion vertically for supporting the baby's head. The headrest also has a folded configuration with the headrest folded down with respect to the upper edge of the baby support portion.

BRIEF DESCRIPTION OF THE DRAWINGS

Various features, aspects, and advantages of the present disclosure will be better understood when the following detailed description is read with reference to the accompanying figures in which like characters represent like parts throughout the figures, wherein.

DETAILED DESCRIPTION OF THE INVENTION

Figure 1:
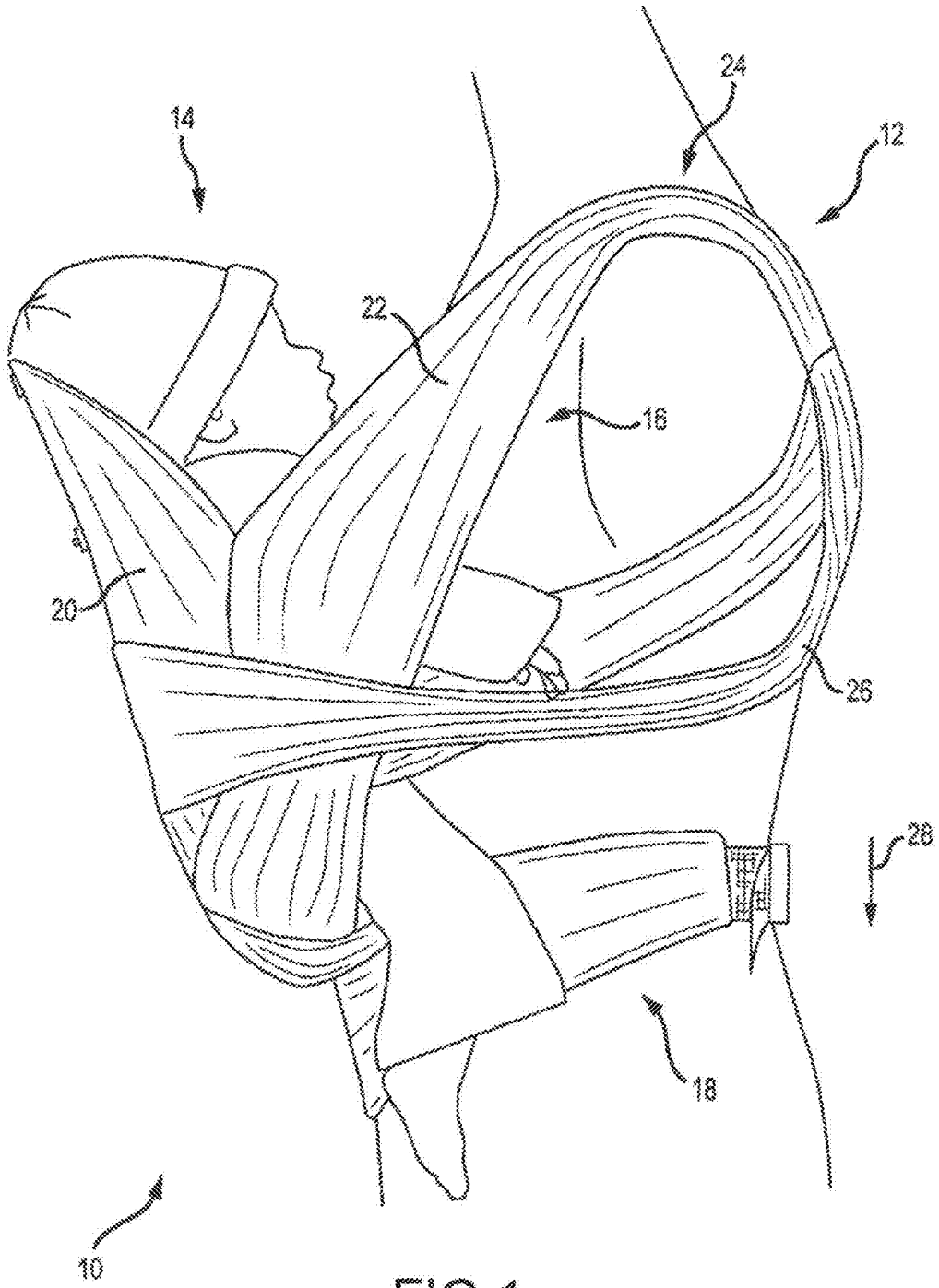
FIG. 1 is a side view of an example of a baby carrier supporting an infant.

One or more specific examples of the present disclosure will be described below. These examples are only exemplary of the present disclosure. Additionally, in an effort to provide a concise description of these exemplary examples, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The discussion below describes examples of a baby carrier that is comfortable, aesthetically pleasing, and easy to assemble. The term baby is understood to mean a child up to approximately three years of age and weighing up to approximately thirty-five pounds. The baby carrier includes a belt for coupling the baby carrier to a caregiver. The belt in turn couples to a baby support portion that receives the infant. The baby carrier includes two shoulder straps that couple to the caregiver to further support and secure the infant. In some examples, the baby carrier may include ties coupled to the loops that enable adjustment of the baby carrier (e.g., lift the infant, pull the baby closer to the caregiver). These ties may also secure the shoulder straps to the caregiver's shoulders when tied in a knot around the caregiver.

The shoulder straps may be made from a single piece of fabric or multiple pieces of fabric and connected to the baby carrier at each end to form a loop. The shoulder straps may include an adjustment device to adjust the length or tension in the shoulder straps. For example, the adjustment device may be used to tighten the shoulder straps around the shoulders of the caregiver. The shoulder straps may connect to the baby support portion and/or the belt. A lower end of the shoulder straps may connect to the belt or a lower portion of the baby support near the belt. One particularly useful location is midway between the top and bottom of the baby support. The opposite (or top) end of the shoulder straps may connect to the baby support at a location spaced above the lower end of the shoulder strap. One particularly useful location is near the top end of the baby support, thereby forming a loop.

The ties that are used to wrap around the caregiver to further secure the carrier to the caregiver may be coupled to the belt, the baby support, the shoulder straps, or combinations thereof. In some instances, the ties may be sewn or otherwise affixed to attachment points on any of the above locations, provided that the ties have free ends to permit them to be tied together.

The ties may be a single piece of fabric or may include several layers of fabric sewn together into a composite. The ties may have any number of shapes or widths that varies over the length of each tie. In some instances, the ties may each have a consistent width over the entire length. In some instances, the ties may taper from the attachment point with the carrier to a free end.

The ties may be connected or coupled to the baby carrier in a variety of ways and at a variety of locations. For example, the ties may be connected or sewn directly to the shoulder straps, to the belt and/or to the baby support. In some cases, the ties may simply be an extension of the shoulder straps and/or the baby support. The ties may be slidably coupled to the shoulder straps to allow relative movement between the two. In some instances, the ties may form a passage or tunnel through which the shoulder straps slide. In this way, the ties can slide over the shoulder straps. In some instances, the ties may have bands attached to its edges to form one or more passages through which the shoulder straps may pass. In some other examples, the opposite edges of the ties may be sewn or directly connected together to form the passage for receiving the shoulder strap. The passageway through which the ties pass may range in length from about one inch to about ten inches. In some examples, the passageway may be approximately four inches in length.

In some examples, the slidable coupling of the ties and the shoulder straps may be accomplished with additional elements such as tubing formed from or attached to the ties or with elastic members connected to both the shoulder strap and the tie. The elastic member may keep the ties and the shoulder straps together or arranged correctly but also allow adjustment or movement relative to one another. Further examples of mechanisms or structures designed to achieve the slidable connection between the tie and the shoulder strap may involve the use of a channel and follower. For example, the tie may have a channel formed in a portion of its length while the shoulder strap has a button or other insert designed to fit in the channel and move along one axis.

The baby support may include a headrest at an upper end that is designed to be positioned behind the head of a baby when the baby is positioned in an inward facing position (facing the caregiver). In some instances, the headrest may fold down over the carrier so as to not cover the baby's face when held in an outward facing position (turned away from the caregiver). The headrest may fold down and be secured to the baby support using a variety of fastening mechanisms, such as a snap, a hook and loop fastener, a button, or other securing device. The headrest may be an extension of the baby support or may be a separate component connected to the baby support. For instance, the headrest may be sewn onto the baby support or may in some instances even be removable from the baby support. In some examples, the headrest may releasably connect to the shoulder straps, to the ties, and/or to the baby support. The headrest may attach to the baby support at its upper end (opposite the belt). Further, the securing devices may be located on lateral sides of the headrest, which in some cases may include tabs to facilitate coupling of the ties to the baby support. For example, when the tabs are coupled to the baby support, they form passages or tunnels to retain the ties. In some examples, the headrest, including the securing devices or tabs, may be covered by the ties and hidden from view.

The baby carrier may be configured to accommodate babies that are held facing the caregiver or away from the caregiver. To do so, the portion of the support that couples to the belt may be adjustable between a wide and a narrow configuration. The baby support may include flaps or lateral edges having buttons, snaps, or other releasable attachments on either side of where the baby support attaches to the belt. The belt may include button holes, snaps, or matching releasable attachments to connect to the flaps and serve to cause the length of the attachment between the belt and the baby support to increase. The wide configuration, with each of the flaps connected to the belt, serves to provide a greater seat area and coverage for a baby in the carrier. The flaps may be disconnected or not attached to result in a narrow configuration. The wide configuration is well-suited for an inward facing baby while the narrow configuration, according to some examples, is well-suited for a baby facing outwards. The narrow configuration results in less outward flexing or bending of the baby's hips while in the carrier.

The belt of the baby carrier may have a particular shape suited for supporting the weight of a baby. In some instances, the belt may have straight or flat edges parallel to each other. In other examples, the belt may have curved edges resulting in different widths along the length of the belt. The upper edge of the belt may taper from a middle portion of the belt. In some examples, the belt may have a highest point or widest portion on each side of the center of the belt and may have a reduced width or height in the center of the belt. The higher edge in the middle portion of the belt with the reduced height at the center of the belt at the attachment of the baby support to the belt may result in a seat scoop which provides a comfortable seat and additional space for a baby seated in the carrier. In other words, the belt may increase in height from a first end to a point adjacent the center of the belt, after which the height of the belt may decrease until reaching the center of the belt. The lower edge of the belt may have a flat profile or may have a curved or tapered profile. In some instances, the lower edge may taper from a middle portion towards both ends of the belt. The center or middle portion of the belt may include a pocket, and the larger area resulting from the curved lower edge may increase the size of the pocket. In some instances, the pocket may have a zippered closure, a hook and loop closure, or other closing device. In some further instances, the pocket may be sufficiently large to fold and stow the baby support, shoulder straps, and ties of the baby carrier inside.

There may be more than one pocket on the belt for storage. In some examples, the storage pocket on the middle portion of the belt may be configured for storage of items for a caregiver's convenience. A second pocket may be configured for storage of the carrier in a pouch. The second pocket may, in some instances, be disposed at the bottom edge of the belt and contain a pouch or fabric container within the pocket that, when removed or partially removed from the pocket, is shaped and sized to fit the carrier inside.

Turning now to the figures, FIG. 1 is a side view of an example of a baby carrier 10 worn by a caregiver 12 to support a baby 14. As illustrated, the baby carrier 10 places the baby 14 next to the caregiver's chest 16. The close proximity between the baby 14 and the caregiver's chest 16 may naturally soothe and comfort the baby 14. This position also enables the caregiver 12 to observe and comfort the baby 14 (e.g., feed, touch).

The baby carrier 10 includes several pieces that both support the baby 14 and facilitate wearing of the baby carrier 10. The baby carrier 10 includes a belt 18 that provides a first point of contact with the caregiver 12 and carries some of the infant's weight. Attached to the belt is a baby support portion 20 that supports the baby 14. The baby carrier 10 provides further load bearing support by including shoulder straps 22 formed from fabric loops. The baby carrier 10 includes two shoulder straps 22, one for each shoulder 24. The shoulder straps 22 couple to the baby support portion 20 and when worn over the shoulders 24 support and hold the baby 14 close to the caregiver's chest 16. In some examples, the baby carrier 10 may include ties 26 that attach to the shoulder straps 22. The ties 26 enable the caregiver 12 to adjust the position of the baby 14 as well as secure the shoulder straps 22 on the shoulders 24. For example, the ties 26 may enable the caregiver 12 to lift and bring the baby 14 closer to their chest 16. To adjust the infant's position, the caregiver 12 pulls down on the ties 26 in direction 28. As the ties 26 move in direction 28, they pull and rotate the shoulder straps 22 around the shoulders 24. The shoulder straps 22 in turn lift the baby 14 and pull the baby support portion 20 closer to the chest 16. This new position may then be secured by tying the ties 26 together around the caregiver 12.

Figure 2:
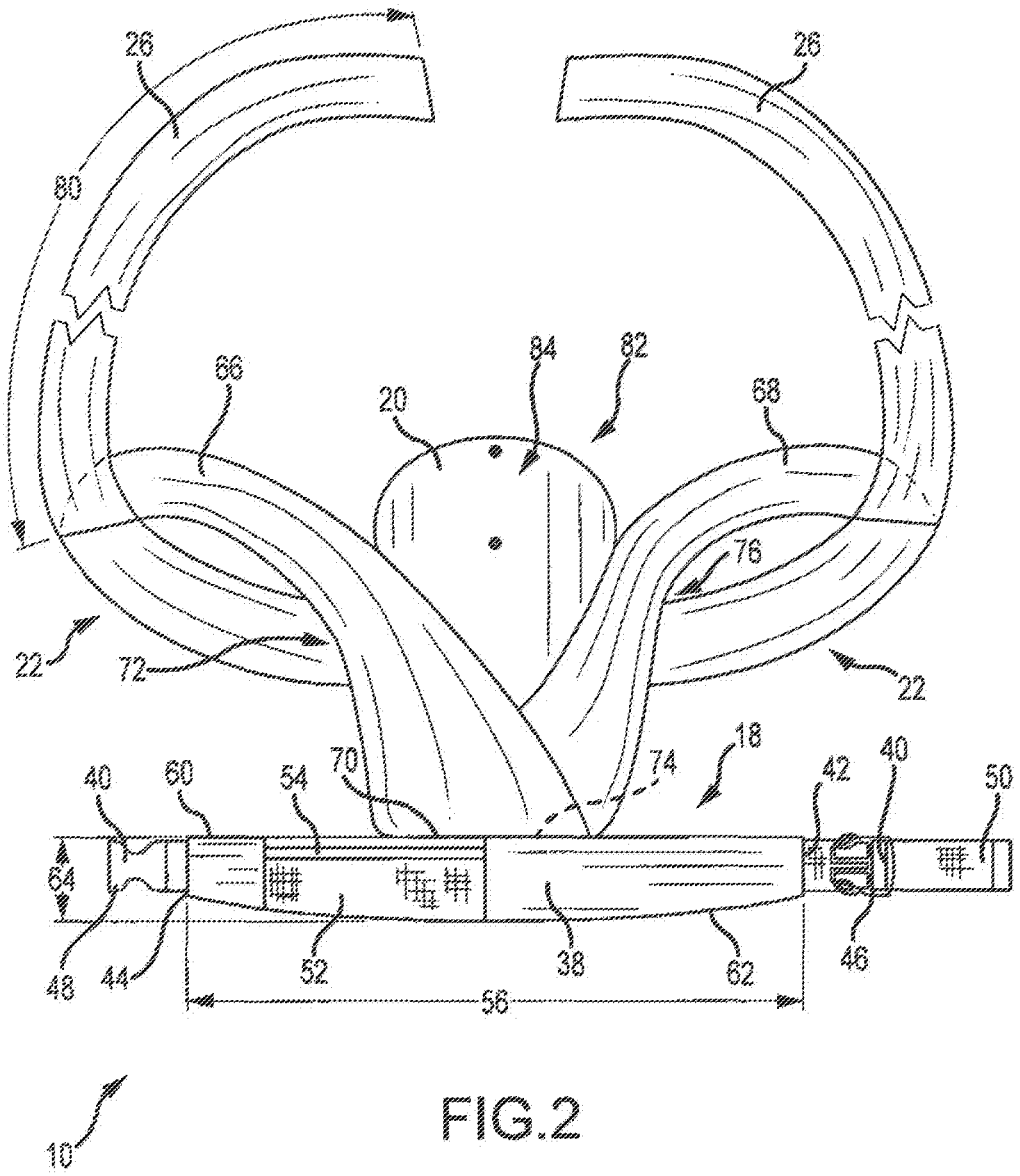
FIG. 2 is a front view of an example of a baby carrier.

FIG. 2 is a front view of an example of the baby carrier 10. As explained above, the baby carrier 10 includes the belt 18 that couples to the baby support portion 20. In some examples, the belt 18 includes a belt portion 38 and a buckle system 40 that couples together first and second opposing ends 42, 44 of the belt portion 38. In some examples, the buckle system 40 may be a snap-fit buckle system with a male connector 46 and a female connector 48. In other examples, the buckle system 40 may be D-rings, snaps, hook and loop fastener, etc. In still other examples, the buckle system 40 may be fabric that the caregiver 12 ties together to secure the belt 18.

In FIG. 2, the buckle system 40 is adjustable to accommodate differently sized caregivers. For example, the buckle system 40 may include an adjustable strap 50 that can lengthen or shorten the distance between the male connector 46 and the end 42 of the belt portion. In another example, the female connector 48 may couple to an adjustable strap 50 that enables the female connector 48 to change distance between the belt portion 38 and the second end 44 of the belt portion 38. In still other examples, both the male and female connectors 46, 48 may couple to respective adjustable straps 50 to enable size adjustment of the belt 18.

The belt 18 may include one or more pockets 52 for storing various items (e.g., keys, snacks, wallet, ID, etc.). The pocket 52 may open and close with a zipper 54. In other examples, the caregiver 12 may secure the contents of the pocket 52 with a button; hook and loop fastener; etc. The pocket 52 extends over a section of the belt portion 38, but in some examples, the pocket 52 may extend over the length 56 of the belt portion 38. The length 56 of the belt portion 38 may be between 15-30 inches and preferably between 18-27 inches. In some examples, the belt portion 38 may define a shape other than rectangular. For example, the belt portion 38 may be generally rectangular, irregular, oval, etc. In FIG. 2, the belt portion 38 is generally rectangular with a straight first side 60 and a curved second side 62. As seen, the curved second side 62 forms a maximum width 64 at the center of the belt portion 38. By maximizing the width of the belt 18 at the center of the belt portion 38, the baby carrier 10 may increase comfort by reducing the pressure of the belt 18 on a caregiver's stomach by spreading the force from the infant's weight over a greater area.

As explained above, the baby carrier 10 includes shoulder straps 22 that couple the baby carrier 10 to the caregiver's shoulders 24. The shoulder straps 22 are not adjustable. That is the size of the shoulder straps 22 does not change except in response to stretching or contracting of the fabric. These fixed sized shoulder straps 22 reduce the complexity of the baby carrier 10 (i.e., fewer adjustment mechanisms). A simpler baby carrier 10 may facilitate putting on the baby carrier 10 as well as manufacturing.

The shoulder straps 22 are formed by coupling a respective first and second single pieces of fabric 66 or 68 (e.g., jersey knit fabric, cotton, polyester, woven fabrics) to the baby support portion 20. The first piece of fabric 66 defines a first end 70 and a second end 72. In some examples, the first end 70 couples (e.g., is sewn) to the belt 18, and the second end 72 couples (e.g., is sewn) to the baby support portion 20. In another example, the first end 70 couples to the baby support portion 20. And in still another example, the first end 70 couples to both the baby support portion 20 and the belt 18. The shoulder strap 22 on the opposite side of the baby carrier 10 similarly defines a first end 74 and a second end 76. The first end 74 may likewise couple to the belt 18 and/or the baby support portion 20, while the second end 76 couples to the baby support portion 20. In some examples, the fabric forming the shoulder straps 22 may decrease in width from the first ends 70, 74 to the second ends 72, 76. In other examples, the width of the first and second pieces of fabric 66 or 68 may not change between the first ends 70, 74 and the second ends 72, 76. In some examples, the shoulder straps 22 may partially overlap at their first ends 70, 74. The overlap may be decorative as well as functional. That is the location of the first ends 70, 74 may pull the shoulder straps 22 closer to the center of the baby support portion 20, which in turn helps keep the shoulder straps 22 on the shoulders 24.

As illustrated, the shoulder straps 22 are made out of a single piece of fabric 66, 68, which may increase the structural integrity of the shoulder straps 22 and of the baby carrier 10. Coupled to the shoulder straps 22 are ties 26 (e.g., adjustment straps). The ties 26 facilitate adjustment of the baby carrier 10 (e.g., lift or lower the baby 14). For example, the caregiver 12 may pull down on the ties 26 to lift and pull the baby 14 closer to the chest 16. By forming shoulder straps 22 out of a single piece of fabric (e.g., 66 or 68) and then coupling the ties 26 to the shoulder straps 22, the shoulder straps 22 may maintain their integrity and still support the baby support portion 20 in the event one or both of the ties 26 separate from the shoulder straps 22 during adjustment of the baby carrier 10. In other words, the shoulder straps 22 will still support the baby support portion 20 if the ties 26 separate from the shoulder straps 22 during use. However, in some examples, the shoulder straps 22 and/or the ties 26 may include multiple pieces of fabric that are securely coupled together (see FIG. 4).

The length 80 of the ties 26 may be between 80-115 inches as measured from a location where the ties 26 connect to the belt 18 to the end of the ties 26, with the length of the ties 26 from the shoulder of the caregiver 12 to the end of the ties in a range between 30-60 inches. The length of the shoulder straps 22 may be between 20-40 inches and preferably at or near 24 inches to accommodate a different size of caregiver 12. Furthermore, the length 80 of the ties 26 enables the caregiver 12 to grab the ties 26, adjust the fit of the baby carrier 10, and secure the baby carrier 10 by tying the ties 26 to each other around the caregiver 12.

In some situations, the caregiver 12 may want to carry the baby 14 facing away from the caregiver's chest 16. However, if the baby 14 faces away from the caregiver 12, some or all of the infant's face may be covered by the baby support portion 20. Accordingly, in some examples, the baby support portion 20 may include a foldable portion 82. The foldable portion 82 can be folded away from the infant's face and towards the belt 18 (see FIG. 15). To keep the foldable portion 82 in a folded position, the baby support portion 20 may include a button snap system 84 that keeps the foldable portion 82 in the folded position (e.g., attached to the another part of the baby support portion 20). In other examples, the button snap system 84 may be a button system, a hook and loop system, etc.

Figure 3:
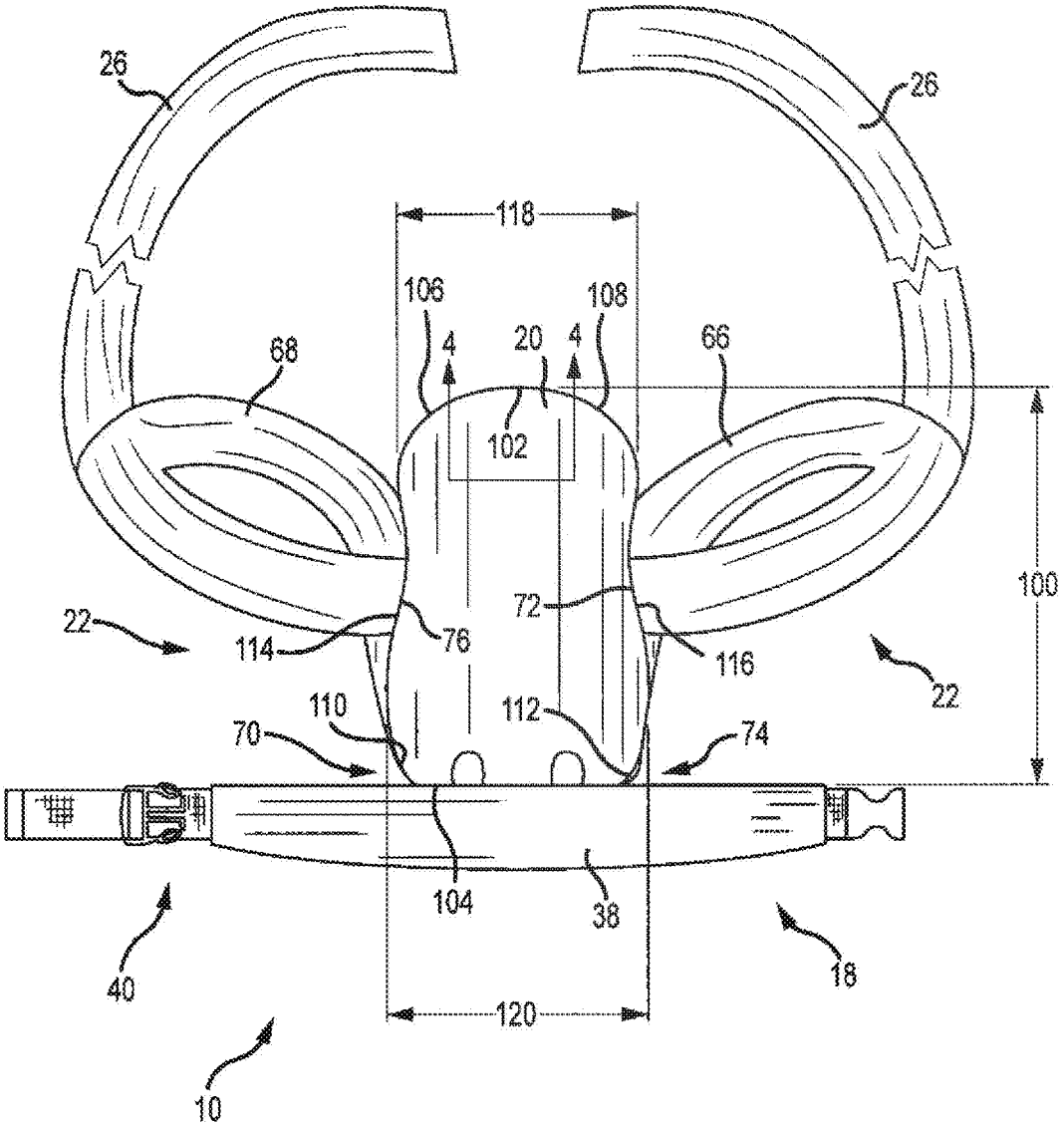
FIG. 3 is a rear view of an example of a baby carrier.

FIG. 3 is rear view of an example of a baby carrier 10. As explained above, the first and second pieces of fabric 66 or 68 couple to the baby support portion 20 to form the shoulder straps 22. The shoulder straps 22 support the baby support portion 20 as well as distribute the weight of the baby 14. The shoulder straps 22 may also facilitate retention of the baby 14 in the baby carrier 10. As illustrated, the first ends 70 and 74 of the respective fabrics 66 and 68 couple to the middle of the baby support portion 20. This positions the shoulder straps 22 around the middle of the baby 14 when placed in the baby carrier 10, thus retaining the baby 14 within the baby carrier (see FIG. 1).

The baby support portion 20 defines a length 100 between first and second end 102, 104. The length of the baby support portion 20 may be between 8-30 inches preferably between 12-25 inches. In some examples, the first end 102 may be curved in order to increase the length 100 of the baby support portion 20 to support the head and neck of the baby 14, while the curved portions 106 and 108 of the end 102 may increase the ability of the baby 14 to see out of the baby carrier 10 when looking to the side. The second end 104 couples to the belt 18 and may likewise include curved portions 110 and 112. The curved portions 110 and 112 accommodate the legs and hips of the baby 14. This may increase baby comfort and block/reduce hip dysplasia when carried in the baby carrier 10. More specifically, the curved portions 110 and 112 may reduce spreading of the hips and legs of the baby 14 in the baby carrier 10.

Opposing first and second sides 114 and 116 of the baby support portion 20 may also be curved. The curved first and second sides 114, 116 may reduce the amount of fabric in contact with the baby 14 and thus increase breathability of the baby carrier 10. The curved first and second sides 114, 116 may also increase baby comfort by enabling the baby to more easily turn and move their arms. In some examples, the first end 102 may define a width 118 that is less than the width 120 of the second end 104. For example, the width 118 of the first end 102 may be 4-25 inches or about 7 to about 18 inches, and the width 120 may be about 5 to about 20 inches or about 10 to about 15 inches.

Figure 4:
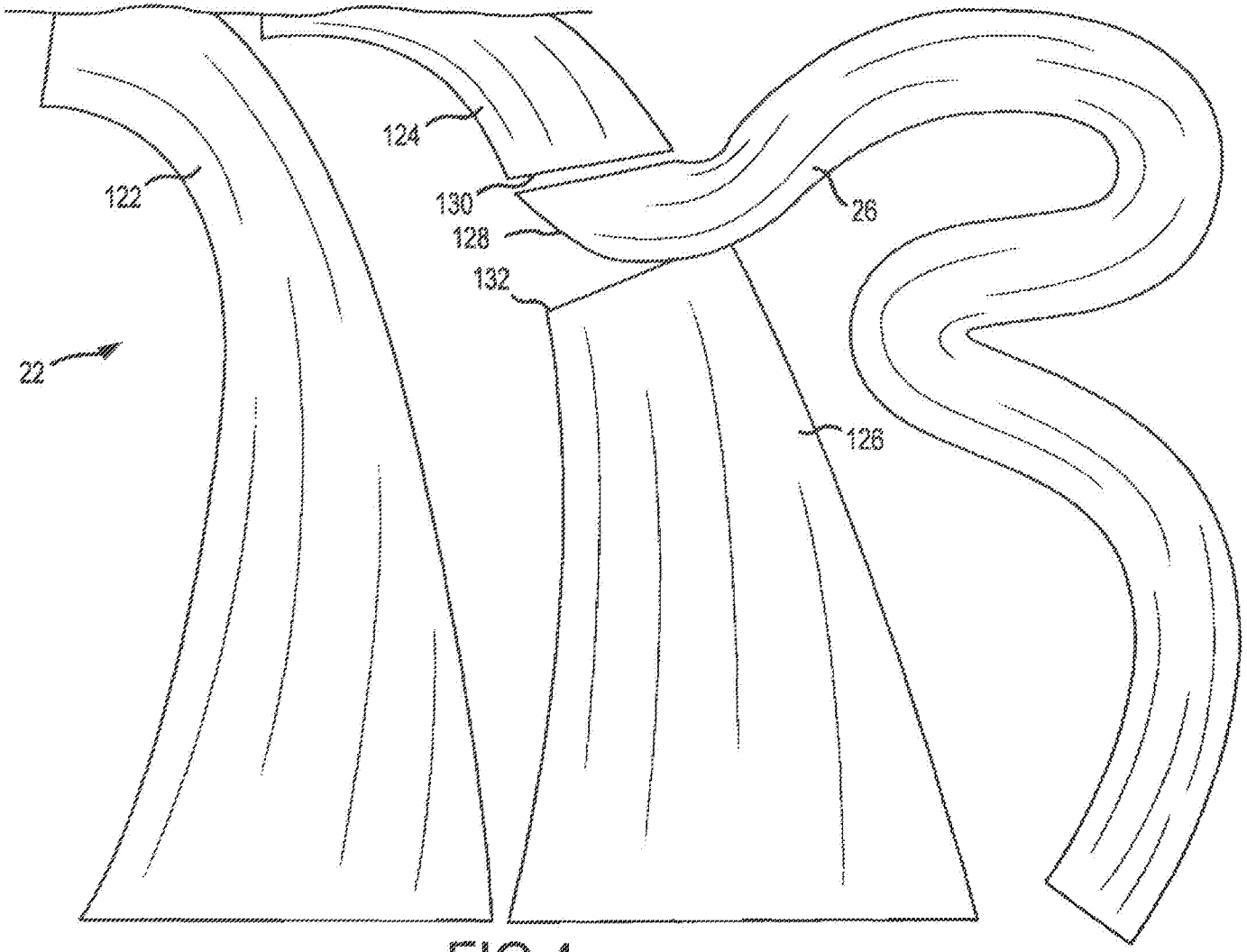
FIG. 4 is a front view of an example of a shoulder strap and tie before assembly.

FIG. 4 is a front view of an example of a shoulder strap 22 before assembly. As explained above, the shoulder strap 22 may be made out of multiple pieces or out of a single piece of fabric. For example, the shoulder straps 22 may include a liner 122 made of a one-piece lining, a first outer facing piece 124, and a second outer facing piece 126. During assembly an end 128 of the ties 26 is coupled (e.g., sewn) to an end 130 of the first outer facing piece 124 and to an end 132 of the second outer facing piece 126. The first and second outer facing pieces 124, 126 are then coupled (e.g., sewn) to the liner 122 to form the shoulder strap 22 with the attached ties 26. This arrangement may increase the structural integrity of the baby carrier 10. For example, if the connection between the shoulder straps 22 and the ties 26 weakens, the ties 26 separate from the shoulder straps 22 leaving the shoulder straps 22 intact. More specifically, the ties 26 may separate from the first and/or second outer facing pieces 124, 126 while the liner 122 of the shoulder strap 22 remains intact to support the baby support portion 20.

Figure 5:
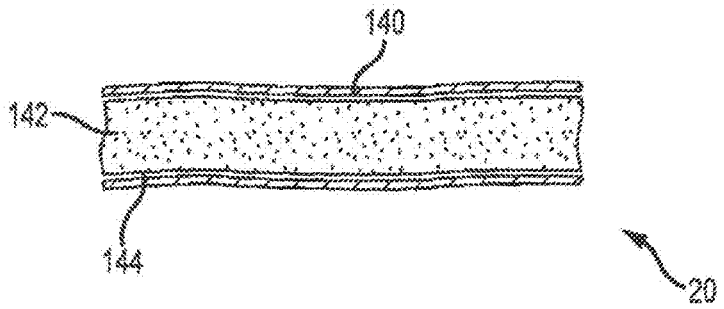
FIG. 5 is a cross-sectional view of an example of a baby support portion.

FIG. 5 is a cross-sectional view of an example of a baby support portion 20 of the baby carrier 10. As illustrated, the baby support portion 20 may include layers (e.g., 1, 2, 3, 4, 5). For example, the baby support portion 20 may include three layers: a first layer 140, a second layer 142, and a third layer 144. The first and third layers 140 and 144 may be fabric layers (e.g., jersey knit fabric), while the second layer 142 may be a fill layer (e.g., open cell foam, batting, fiber fill, foam, memory foam) that may insulate and/or increase the comfort of the baby 14. The first and third layers 140, 144 may be included for aesthetic purposes and to protect the second layer 142 from wear (e.g., washings and other normal wear and tear). In some examples, the shoulder straps 22 may also include multiple layers (e.g., 1, 2, 3, 4, 5) to increase the comfort of the caregiver 12 while wearing the baby carrier 10. For example, the shoulder straps 22 may include multiple layers at point where the shoulder straps 22 rest on the caregiver's shoulders 24.

Figure 6:
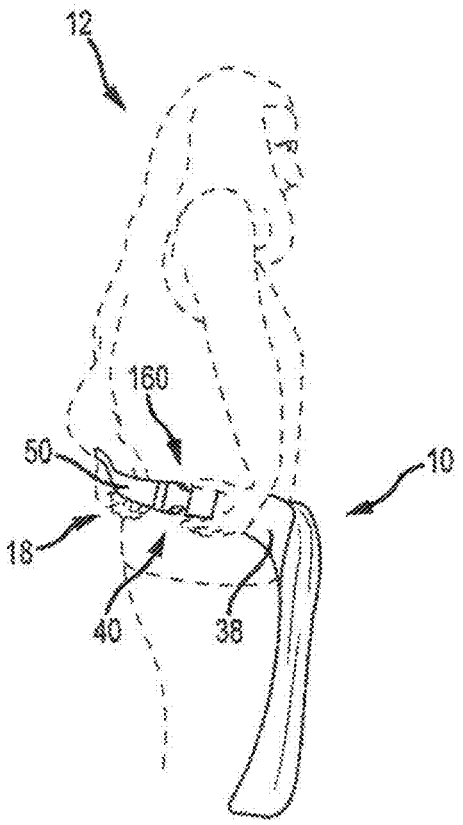
FIG. 6 is a side view of a caregiver coupling a belt of the baby carrier around the waist.

FIGS. 6-15 illustrate a method of putting on and adjusting the baby carrier 10. FIG. 6 is a side view of a caregiver 12 coupling the belt 18 of the baby carrier 10 around the caregiver's waist 160. As explained above, the belt 18 may include a buckle system 40 with a male connector 46 and a female connector 48 that couple together to secure the belt 18 around the waist 160 of the caregiver 12. After connecting the male connector 46 to the female connector 48, the caregiver 12 may adjust the belt 18 for comfort by tightening or loosening the adjustable strap 50.

Figure 7:
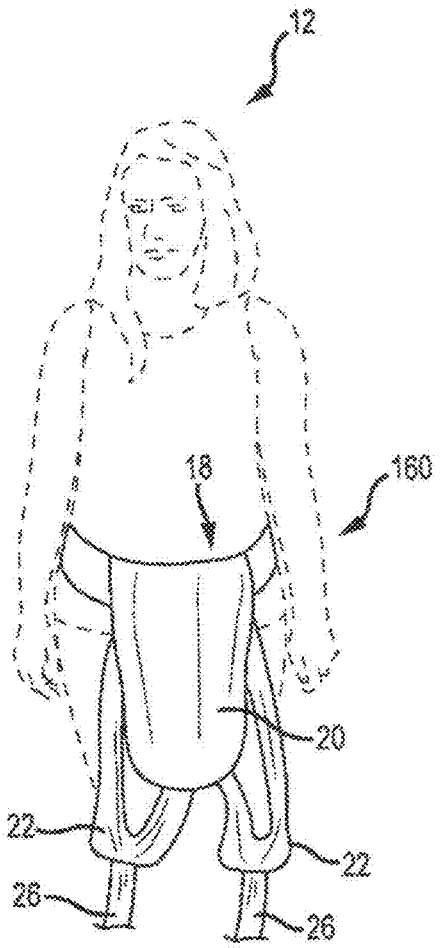
FIG. 7 is a front view of a caregiver with the baby carrier coupled around the waist.

FIG. 7 is a front view of a caregiver 12 with the baby carrier 10 coupled around the waist 160. After adjusting the belt 18, the caregiver 12 rotates the baby carrier 10 so that the baby support portion 20, the shoulder straps 22, and the ties 26 are in front of the caregiver 12.

Figure 8:
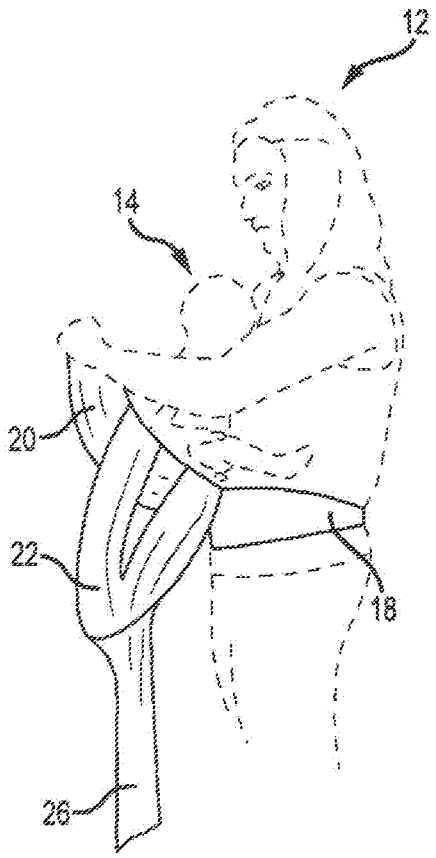
FIG. 8 is a side view of a caregiver placing a baby in the baby carrier.
Figure 9:
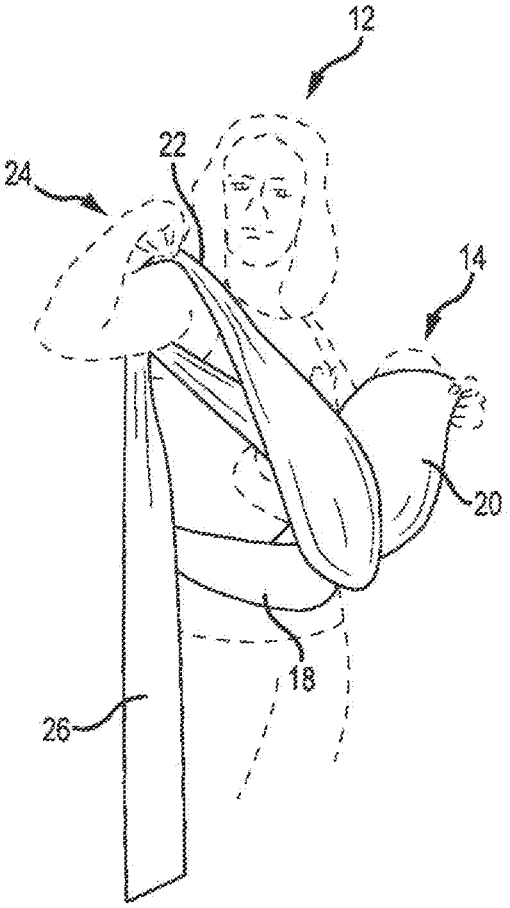
FIG. 9 is a perspective view of a caregiver with a first shoulder strap of the baby carrier on a first shoulder.
Figure 10:
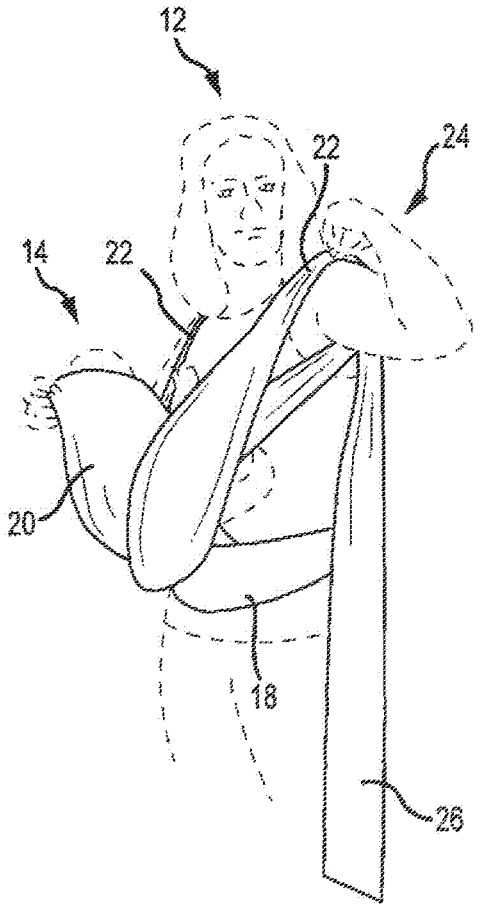
FIG. 10 is a perspective view of a caregiver with a second shoulder strap of the baby carrier on a second shoulder.

The caregiver 12 then grabs and lifts the baby support portion 20 and places the baby 14 in the baby support portion 20, as illustrated in FIG. 8. While supporting the baby 14, the caregiver 12 places one of the shoulder straps 22 and ties 26 over one of the shoulders, as illustrated in FIG. 9. The caregiver 12 may then switch hands to support the baby 14. After switching hands, the caregiver places the other shoulder strap 22 and tie 26 over the opposite shoulder 24, as illustrated FIG. 10. In this position, the baby 14 is secured and supported by the baby carrier 10.

Figure 11:
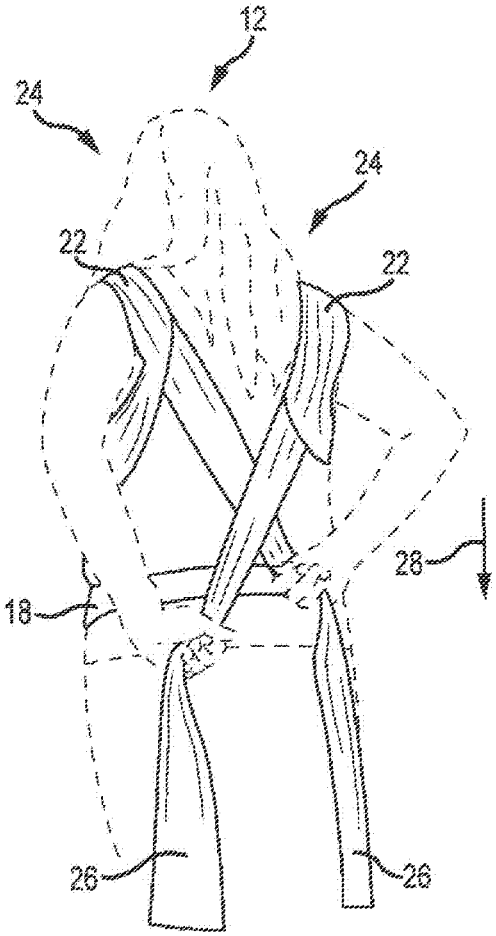
FIG. 11 is a rear perspective view of a caregiver crossing and pulling a first tie coupled to the first shoulder strap and a second tie coupled to a second shoulder strap.

FIG. 11 is a rear perspective view of a caregiver 12 crossing and pulling the ties 26. As explained above, the baby carrier 10 may be adjusted to increase the comfort of the baby 14 and caregiver 12. To adjust the baby carrier 10, the caregiver 12 crosses and pulls down on the ties 26 in direction 28. The downward force rotates the shoulder straps 22 around the shoulders 24, which lifts and pulls the baby support portion 20 closer to the caregiver's chest 16. In some examples, the shoulder straps 22 and the ties 26 are made out of the separate pieces of fabric. The ties 26 are coupled to the shoulder straps 22 by sewing, etc. This arrangement may increase the structural integrity of the baby carrier 10. For example, if the connection between the shoulder straps 22 and the ties 26 weakens, the ties 26 separate from the shoulder straps 22. The shoulder straps 22 therefore remain intact and continue to support the baby support portion 20, and thus the baby 14.

Figure 12:
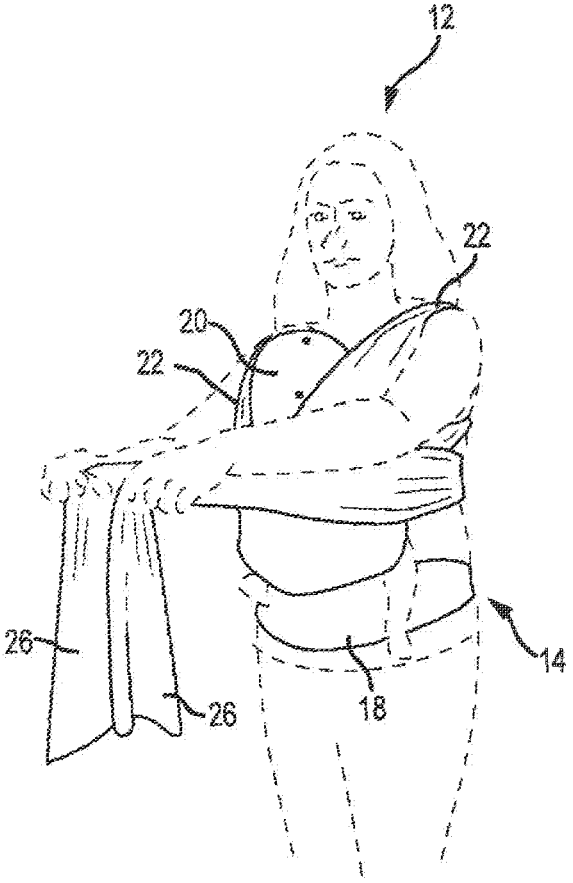
FIG. 12 is a front perspective view of a caregiver pulling the first and second ties in front of the caregiver.
Figure 13:
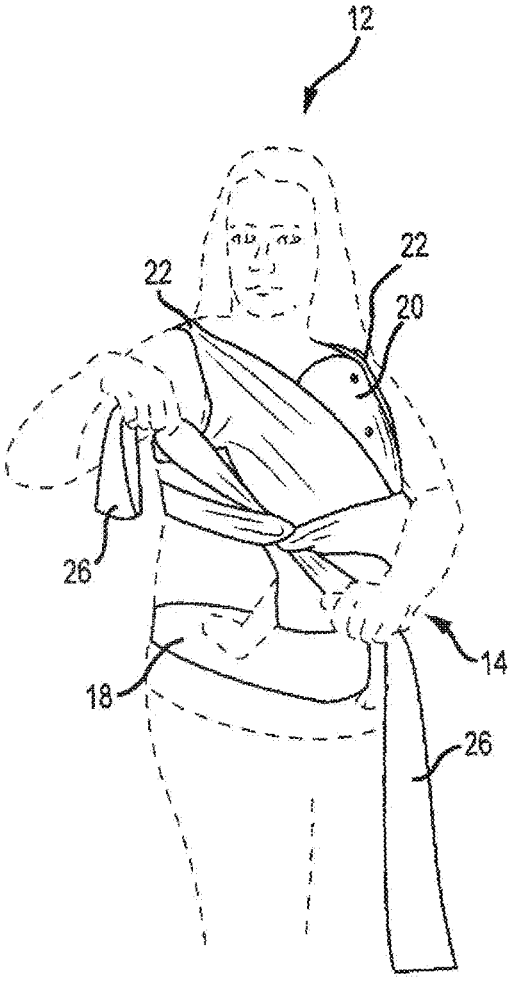
FIG. 13 is a front perspective view of a caregiver tying a knot with the first and second ties.
Figure 14:
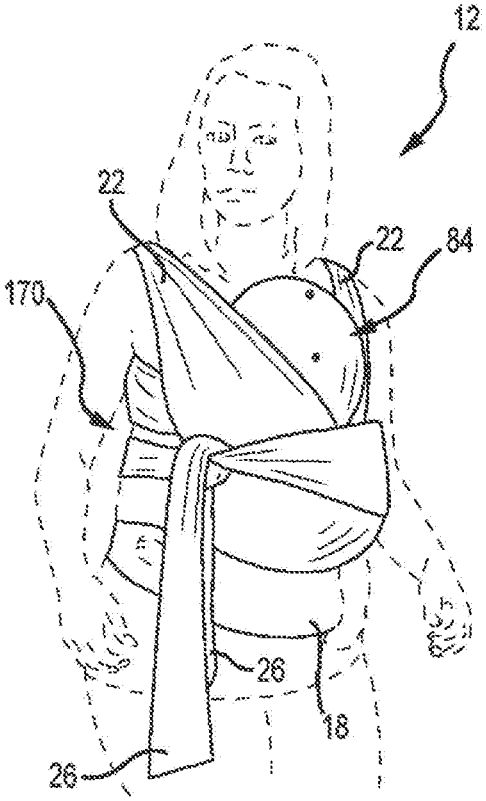
FIG. 14 is a perspective view of a caregiver with the baby carrier.

After adjusting the position of the baby 14, the ties 26 are pulled to the front of the caregiver 12 and past the baby support portion 20, as illustrated in FIG. 12. The ties 26 are then tied into a knot 170 to secure the baby 14 in the desired position, as illustrated in FIGS. 13-14. Depending on the preference of the caregiver 12, the knot 170 may be tied to either side, over, or below the baby support portion 20.

Figure 15:
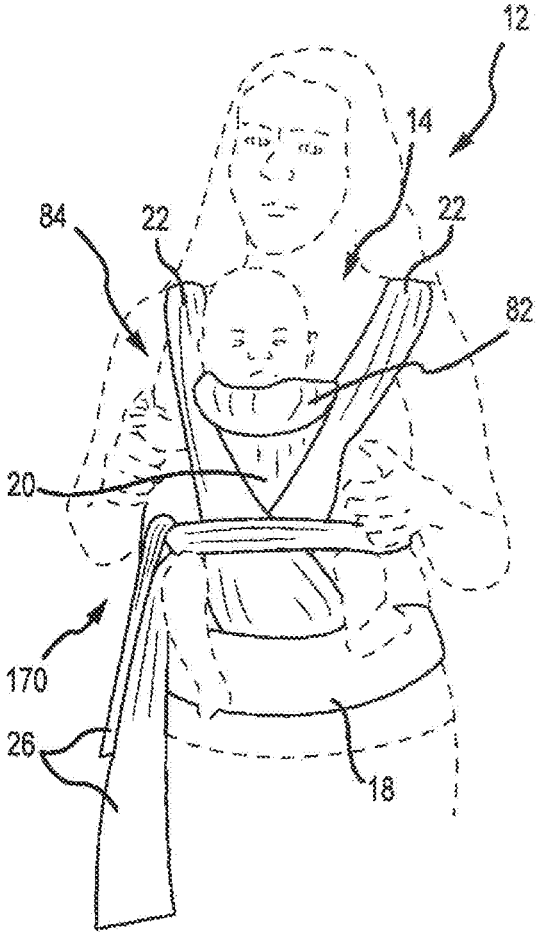
FIG. 15 is a perspective view of a caregiver with the baby facing away from the caregiver in the baby carrier.

As explained above, the baby carrier 10 enables a caregiver 12 to carry the baby 14 facing towards or away from the caregiver 12. FIG. 15 is a perspective view of a caregiver 12 carrying a baby 14 in the baby carrier 10 with the baby 14 facing away from the caregiver 12. In some examples, the baby carrier 10 may include a button snap system 84 that enables a foldable portion 82 to be folded down and away from the infant's face.

Figure 16:
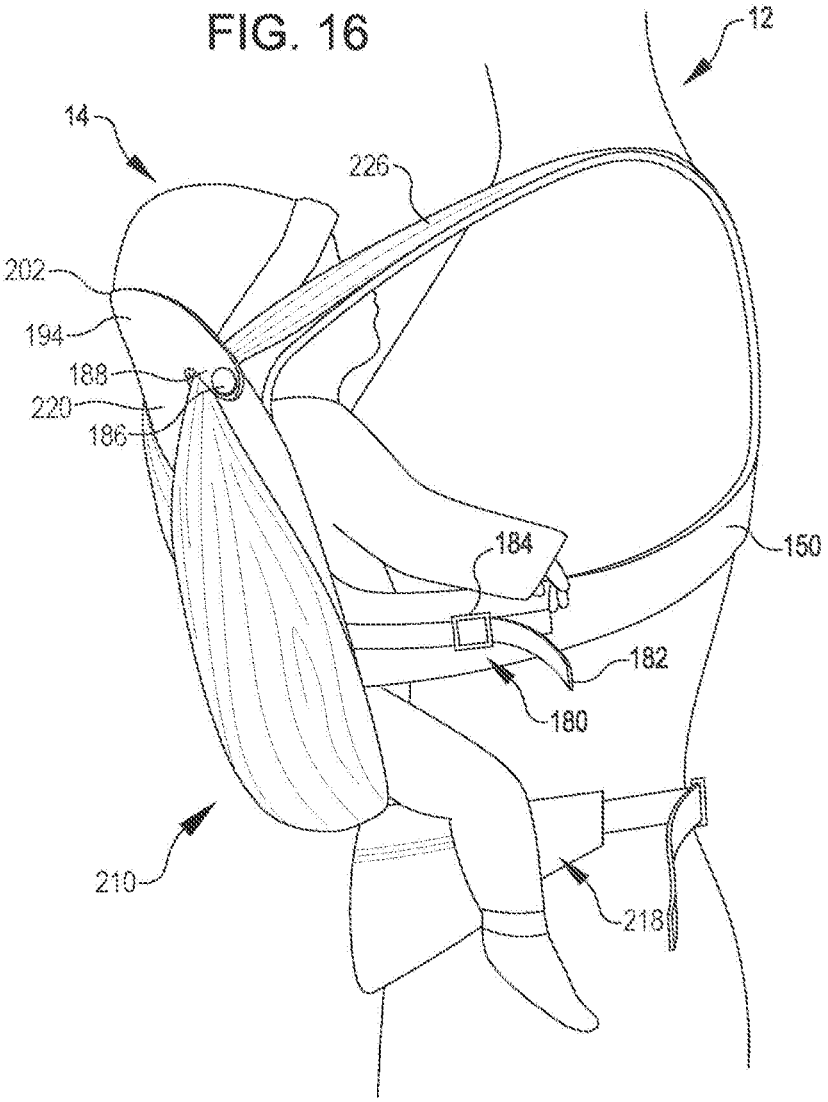
FIG. 16 is a side view of an example of a baby carrier supporting an infant.

FIG. 16 is a side view of an example of a baby carrier 210 worn by a caregiver 12 to support a baby 14. As explained above, the baby carrier, 210 enables a caregiver 12 to carry the baby 14 facing towards or away from the caregiver 12. The baby carrier 210 also allows the caregiver 12 to carry the baby 14 on a front or side (such as a hip carry) of the caregiver 12. The example as shown in FIG. 16 shows the baby carrier 210 worn to carry the baby 14 on the front of the caregiver 12.

The baby carrier 210 includes several components designed to both support the baby 14 and facilitate wearing of the baby carrier 210. As with other examples discussed above, the baby carrier 210 includes a belt 218 designed to provide a first point of contact with the caregiver and carry some of the weight of the baby 14. The belt 218 distributes weight across hips of the caregiver 112. The belt 218 is attached to the baby support portion 220. The baby support portion 220 provides load bearing support to carry or sustain the weight of the baby 14. The baby support portion 220 may be formed of a single layer of fabric or may include layers. For example, the baby support portion 220 may include three layers. The first and third layers and may be fabric layers (e.g., jersey knit fabric, spandex fabric, nylon fabric, cotton fabric), while the second layer may be a fill layer (e.g., open cell foam, batting, fiber fill, foam, memory foam) that may insulate and/or increase the comfort of the baby 14. The first and third layers may be included for aesthetic purposes and to protect the second layer from wear (e.g., washings and other normal wear and tear). The baby support portion may vary in thickness from the thickness of a single piece of fabric to nearly one inch thick. The thickness of the baby support portion may vary over the length and/or the width of the support portion based on where additional padding or material is desired. When the baby 14 is in an inward facing configuration, the baby support portion 220 is in contact with the baby's back. When the baby 14 is in an outward facing configuration, the baby support portion 220 is in contact with the baby's front.

The baby support portion may have a length from top to bottom at in the range from about 12 to about 16 inches, and in some cases around 14 inches. The baby support portion may have a width (along a center portion), that is in the range from about 8 to 12 inches. In some instances, the width of the baby support portion may be about 10 inches. The baby support portion may have a shape that tapers outward from an attachment point with the belt to a wider middle section and may taper inward from the middle portion to the upper end as well. The baby support portion may be stitched to, built integral with, or otherwise connected to the belt. The shoulder straps 150 and ties 226 may also be stitched to or otherwise connected to the baby support portion 220. The ties 226 may be stitched or connected at the same location as the belt 218. In some instances, the shoulder straps 150 may attach at or near the upper end of the baby support portion 220 and the other end of the shoulder straps 150 may connect to a middle portion of the baby support portion 220 at the edges.

Additional load bearing support is provided by two shoulder straps 150. The shoulder straps 150 couple to the baby support portion 220 and are worn over the shoulders of the caregiver 12, with one shoulder strap 150 over each shoulder. When the shoulder straps 150 are worn on the shoulders of the caregiver 12, the baby 14 is supported and held close the caregiver 12. The shoulder straps 150 may also include multiple layers. For example, the shoulder straps 150 may include three layers: a first layer, a second layer, and a third layer. The first and third layers may be fabric layers (e.g., jersey knit fabric, spandex fabric, cotton fabric), while the second layer may be a fill layer (e.g., open cell foam, batting, fiber fill, foam, memory foam). The first and third layers may be included for aesthetic purposes and to protect the second layer from wear (e.g., washings and other normal wear and tear). The shoulder straps 150 may have additional layers to increase the comfort of the caregiver 12 while wearing the baby carrier 210. For example, the shoulder straps 150 may include multiple layers at point where the shoulder straps 150 rest on the caregiver's shoulders.

The shoulder straps 150 may be attached to the baby support portion 220 as described herein. The shoulder straps 150 may have a varying width over the length of the shoulder straps 150. For example, the shoulder straps 150 may vary in width from about 1 to 6 inches. In some instances, the shoulder straps 150 may have a constant width of about 3½ inches. The shoulder straps 150 may have a length, from one attachment point to another attachment point at or around 24 inches. In some instances, the shoulder straps 150 may have a length in the range of 24 to 36 inches.

In some examples, the shoulder straps 150 include length adjustment devices 180. The length adjustment device 180 may include a strap 182 and adjustment buckle 184. The strap 182 may wrap around or through the adjustment buckle 184 and provide length adjustment to the shoulder strap 150, or provide tension or tightness to the shoulder strap 150. The length adjustment device 180 also allows the caregiver 12 to adjust the position of the baby 14 and the baby carrier 10. When the length adjustment device 180 is used to tighten the shoulder strap 150, the baby carrier 10 and baby 14 are positioned higher on the caregiver 12. Though one example of a length adjustment device 180 is shown herein, any device or combination of devices that allow length adjustment in a securable manner is well-suited for this purpose. For example, a series of buttons and button holes, a series of snap closures laid out in a row, hook and loop fasteners, D-rings, or other such devices may be implemented for length adjustment of the shoulder straps 150.

The ties 226, as shown in FIG. 16 may function similarly to other examples herein, and allow the baby 14 to be pulled closer to the body of the caregiver 12. The ties 226 attach at one end to the belt 218, or alternatively to the baby support portion 220 at the second end 204 (not shown in FIG. 16). In some examples, the ties 226 may couple to both the belt 218 and the baby support portion 220. The ties 226 may be stitched to both the belt 218 and the baby support portion 220 or otherwise connected. The ties 226 have sufficient length to wrap around the body of the caregiver 12 and tie together into a knot at an end opposite the end attached to the belt 218 and/or the baby support portion 220.

The baby support portion 220 of FIG. 16 includes, at the first end 202, a headrest 194. The headrest 194, may be similar to the foldable portion 182 of the baby support portion 220 of some examples. On each lateral side of the headrest 194 there are tabs 188 with securing devices 186. The tabs may be of any shape, but are designed to cover or retain the ties 226. The securing devices 186 may be any releasable securing device such as a button and hole, a snap button, or other such device. In FIG. 16, the tab 188 and the securing device 186 retain the ties 226. One effect of this configuration is to change a load distribution of the baby carrier 10. In other examples, the ties 226 may not be retained by the tabs 188 and securing devices 186 and result in a different load distribution on the caregiver 12.

Figure 17:
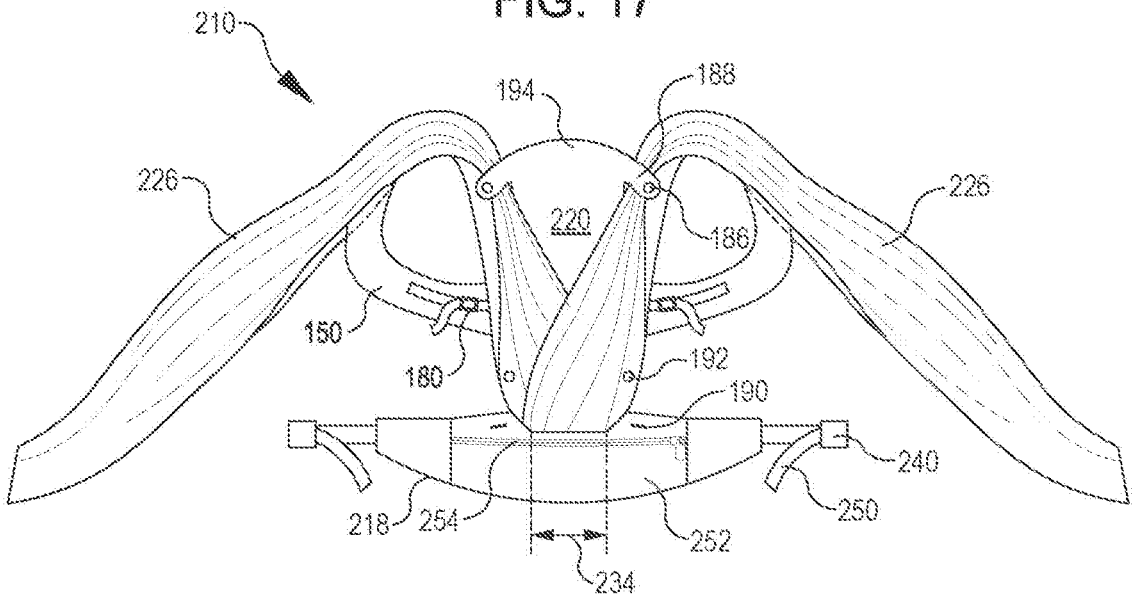
FIG. 17 is a front view of the baby carrier of FIG. 16 arranged in a narrow seat configuration for a baby facing away from the caregiver in the baby carrier.

FIG. 17 shows a front view of an example of the baby carrier 10. The baby carrier 10 includes the belt 218, as described above. The belt 218 includes a buckle system 240 to couple the opposite ends of the belt 218 together around the waist of a caregiver. The buckle system 240 maybe similar to the buckle system 40 described with reference to FIG. 2. The buckle system 240 may include length adjustment devices or be configured to adjust to different lengths based on the size of the caregiver 12. The length adjustment device may be part of the buckle system 240 and allow the buckle system 240 to move along a length of a strap 250 of the belt to adjust the length thereof. The belt 218 includes a pocket 252 closed with a zipper 254. The pocket 252 may extend across a portion of the belt 218 or in some examples the pocket may extend the full width or length of the belt 218. The pocket 252 may be used to store any supplies a caregiver may need, such as wipes, diapers, rags, bibs, snacks, food, or any other items. In some examples, the pocket 252 may be large enough for the baby carrier 210 to be folded up and fit entirely inside the pocket 252. In some cases, the baby support portion 220, the shoulder straps 150, and the ties 226 may fit within the pocket 252 when the baby carrier 10 is not in use.

A second pocket (not shown) may be configured to store the baby carrier 210 within it. In particular, the second pocket may be at a bottom edge of the belt 218 with an invisible or hidden zipper covered or partially covered by fabric. The second pocket may be a plain pocket with a zippered opening or may contain a storage pouch as described below with respect to FIG. 26. In some examples, the second pocket may contain a fabric pouch or pocket that pulls out or folds out of the second pocket and defines or creates a pouch sized to store the baby carrier within it for storage and containment of the straps and ties.

Figure 18:
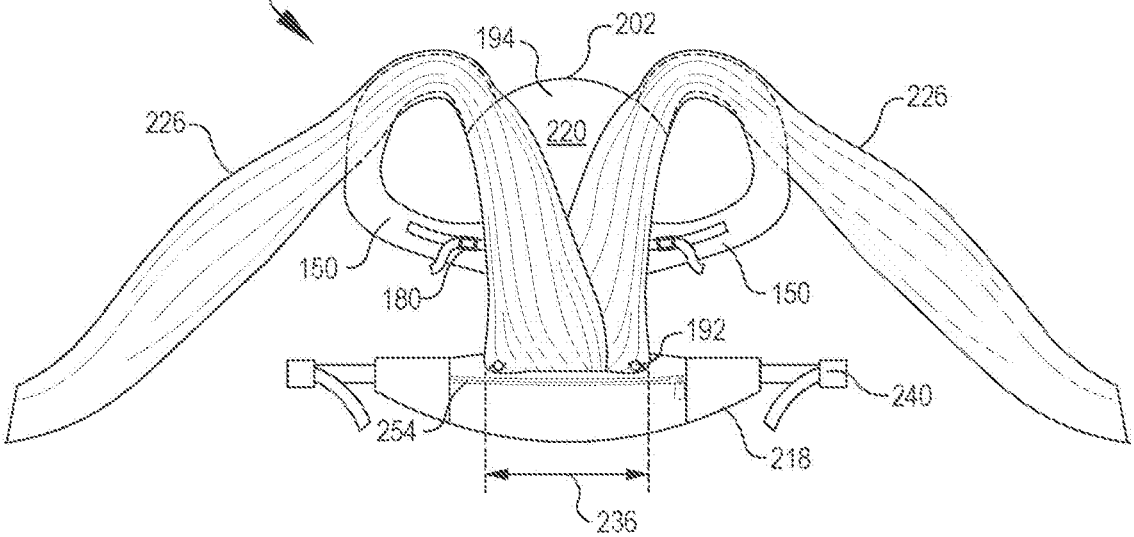
FIG. 18 is a front view of the baby carrier of FIG. 16 arranged in a wide seat configuration for a baby facing towards the caregiver in the baby carrier.

Near an upper edge of the belt 218, the belt 218 includes part of a securing device 190. The securing device 190 may be include a button and a button hole, a snap closure, or other releasable closure. In some instances, there may be one or more securing devices 190 on each side of the baby support portion 220. For example, there may be 2, 3, 4, or 5 securing devices 190 on each side of the baby support portion 220. The multiple securing devices 190 may be spaced along the length of the belt 218 to provide alternatives and options for securing the ties 226 or the baby support portion 220 to the belt 218. The securing devices 192 may be arranged in any pattern or shape to provide optional adjustability for use. For instance, the securing devices 192 may be arranged in a grid or may be along a line or a curve. Another portion of the securing device 192 is disposed on the ties 226. In some instances, the securing device 192 may be located on the baby support portion 220. The portion of the securing device may also be disposed on the baby support portion 220. The securing device 190, 192 allows the ties 226 and/or the baby support portion 220 to be configured in a wide and a narrow configuration. FIG. 17 shows an example of the baby carrier 210 with the ties 226 and/or the baby support portion 220 in a narrow configuration. In the narrow configuration, the width 234 of the ties 226 and/or the baby support portion 220 at the connection with the belt 218 is smaller or narrower than a width 236 of a wide configuration as shown in FIG. 18. The width 234 of the narrow configuration may be seven inches while the width 236 of the wide configuration may be eleven inches. In some examples, the width 234 of the narrow configuration may be in a range of 5 to 9 inches. In some examples, the width 236 of the wide configuration may be in a range of 9 to 13 inches. The narrow configuration may be well-suited for the baby carrier 210 to carry a baby 14 in a forward or outward facing configuration while the wide configuration may be well-suited for the baby carrier 210 to carry a baby 14 in a rearward or inward facing configuration. The narrow configuration may provide additional room for movement of a baby's hips and prevent outward flexing of the baby's legs or hips. In the wide configuration, the additional width may provide additional support or coverage for the baby 14 for increased comfort and weight distribution.

Figure 25:
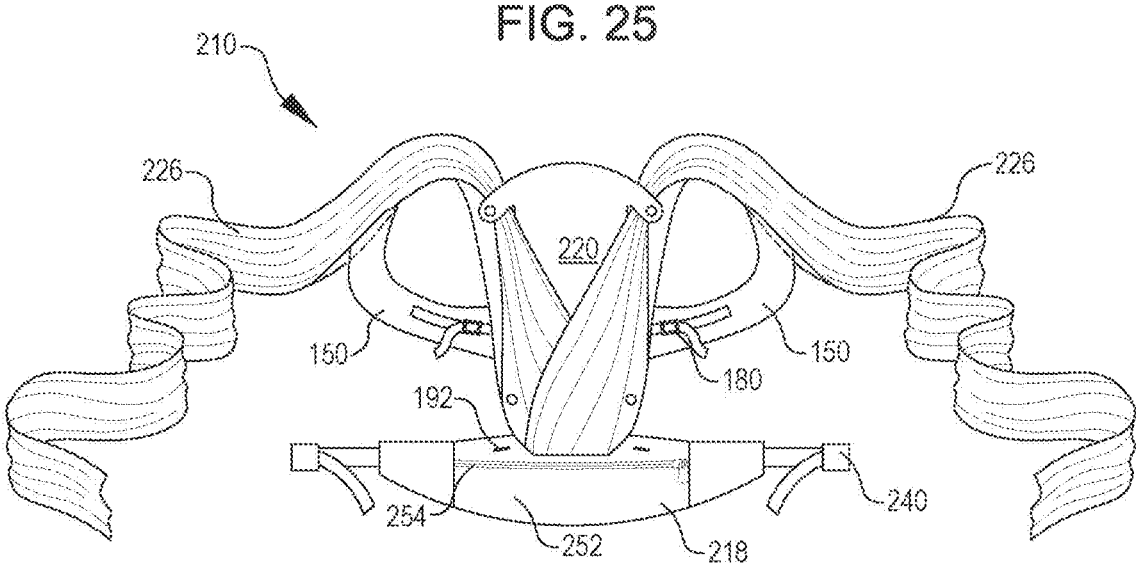
FIG. 25 is a front view of the baby carrier of FIG. 16 showing the ties in more detail.

The headrest 194 as shown in FIG. 17 includes two tabs 188, each having a securing device 186. The headrest 194 is shown in an upwardly extending or unfolded configuration. Other configurations of the headrest 194 are described herein. The tabs 188 and securing devices 186 slidably capture the ties 226. The ties 226 are free to move through the passage created by the tabs 188 and the securing devices 186. The ties 226 may therefore be pulled tight by the caregiver relative to the baby support portion 220, the shoulder straps 150, and the belt 218. The ties 226, by moving relative to the other components of the baby carrier 210, may tighten or carry additional weight of the baby 14. Additionally, tightening or pulling the ties 226 before securing them to each other with a knot will pull the baby 14 closer to the chest of the caregiver 12. The ties 226 as shown in FIGS. 17-21 are not shown to scale, rather, the scaled depiction is shown in FIG. 25.

FIG. 18 is a front view of a baby carrier 210 showing the baby support portion 220 and/or the ties 226 in a wide configuration at the attachment point with the belt 218. The securing device 190, 192 is releasably attached to result in the ties 226 and/or the baby support portion 220 forming a wider base or seat for the baby 14. In the wider configuration, the width 236 of the ties 226 and/or the baby support portion 220 is greater than the width 234 in the narrow configuration as described above. The width 236 is well-suited for an inward facing or rearward facing baby 14 as described above. The headrest 194 may include tabs 188 as shown in FIG. 17, but hidden in FIG. 18, and securing devices 186 as described with respect to FIG. 17. In some cases, the ties 226 need not be captured within the passage formed by the tabs 188 and the securing devices 186. In some instances, the headrest 194 may not include tabs 188 but may still be securable to the baby support portion 220 and/or the shoulder straps 150. In some examples, such as shown in FIG. 18, the headrest 194 including the tabs 188 may be behind the ties 226.

Figure 19:
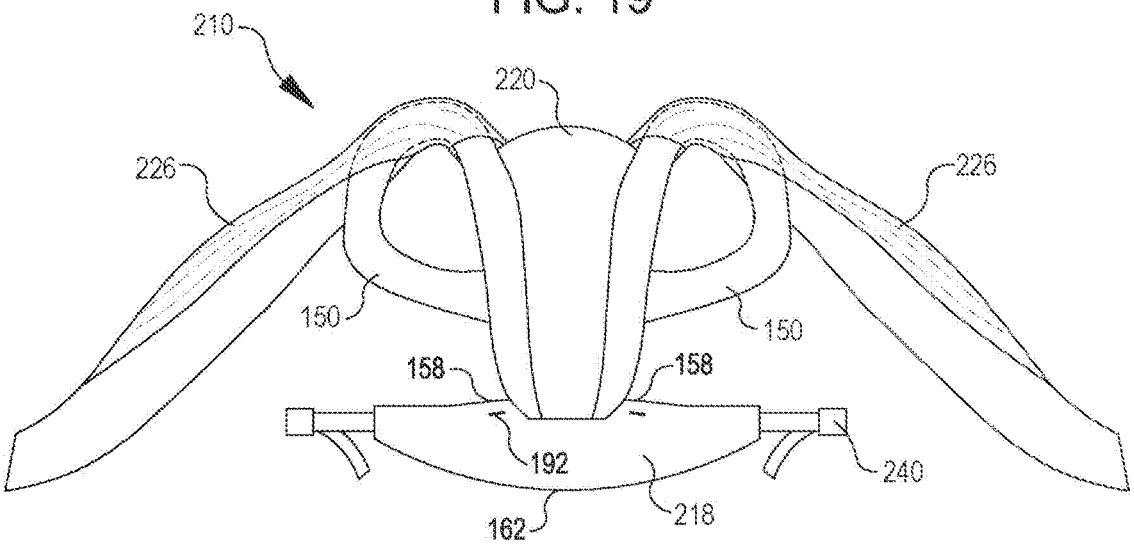
FIG. 19 is a rear view of the baby carrier of FIG. 16 showing a shaped belt.

FIG. 19 is a rear view of a baby carrier 210 showing the baby support portion 220, shoulder straps 150, ties 226, and belt 218. The belt 218 shows a lower edge 162 and an upper edge 158 each having edges that define the shape of the belt 218. The lower edge 162 is shown having a convex shape or curve that tapers towards the ends of the belt 218. The middle portion of the belt 218 is wider than each end of the belt, and therefore allows for a larger pocket as described above and also provides additional structure for support of the baby 14. The upper edge 158 has a shape which may differ from the lower edge 162. The upper edge 158 may, in some examples, have a straight or flat shape. In FIG. 19, the upper edge 158 is shown curving from a thicker or higher middle portion to the ends of the belt 218. The shaped upper edge 158 of the belt 218 provides additional structure and reinforcement for sturdy button holes or attachment points for the securing device 192. For example, the curve of the upper edge 158 as shown provides additional material and allows for stitching or additional material to reinforce a button hole as a securing device 192. Additionally, the curved profile of the upper edge 158 provides an additional seating area or surface for a baby 14. The outward or upwardly curving upper edge 158 near the middle of the belt 218 creates a scoop-like shape for a seat for the baby 14. The scoop-like shape of the seat provides additional stability for a baby 14 placed within the baby carrier 210 and also provides additional comfort and support for the baby 14.

Figure 20:
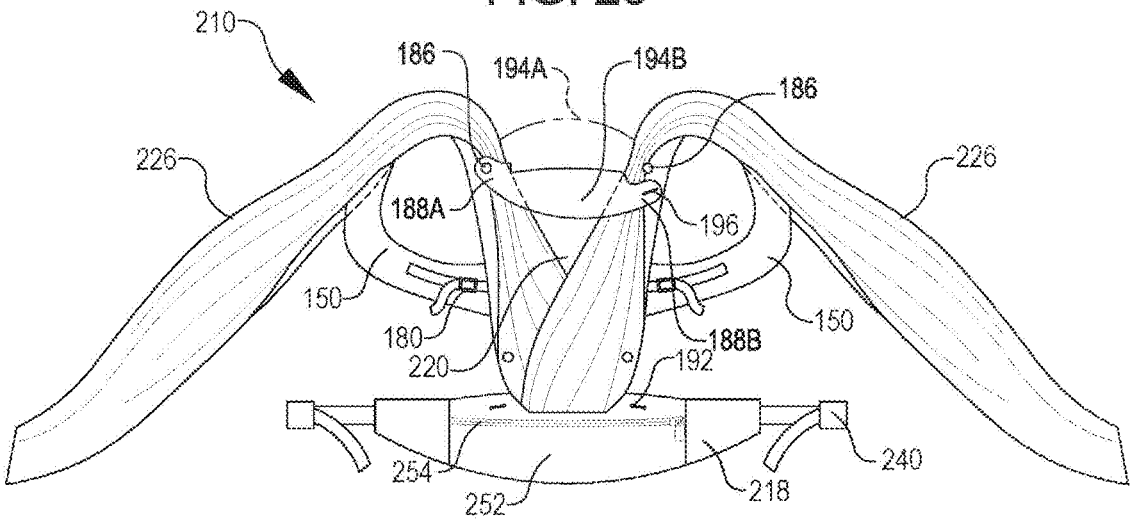
FIG. 20 is a front view of the baby carrier of FIG. 16 showing alternate positions of a foldable headrest.

FIG. 20 is a front view of a baby carrier 210 showing alternative folding examples of a headrest 194. In one example, the headrest 194A is extended along the direction or plane of the baby support portion 220 in an unfolded configuration. The unfolded configuration is intended for a baby 14 facing inward within the baby carrier 210. As described above, the headrest includes tabs 188 and securing devices 186 to releasably secure the tabs 188 to the baby support portion 220 either over or under the ties 226. The folded headrest 194B shows the headrest 194 folded down in a folded configuration for an outward facing baby to keep the headrest 194 out of the face of the baby 14. The folded headrest 194B may be secured using the securing device 186 in a similar manner to the unfolded headrest 194A. As shown in FIG. 20, the left tab 188A is secured to the baby support portion 220 and/or the shoulder strap 150 while the right tab 188B is unsecured with the securing device 186 shown as a button configured to secure in a buttonhole 196 on the right tab 188B. The right tab 188B is positioned in front of the tie 226 but may, in some examples or configurations be positioned behind the tie 226 or in between the tie 226 and the baby support portion 220. The folded headrest 194B may be secured to the baby support portion 220 as described above, or using a securing device (not shown) such as a button and loop, a snap, an elastic band, or other releasable securing device.

Figure 21:
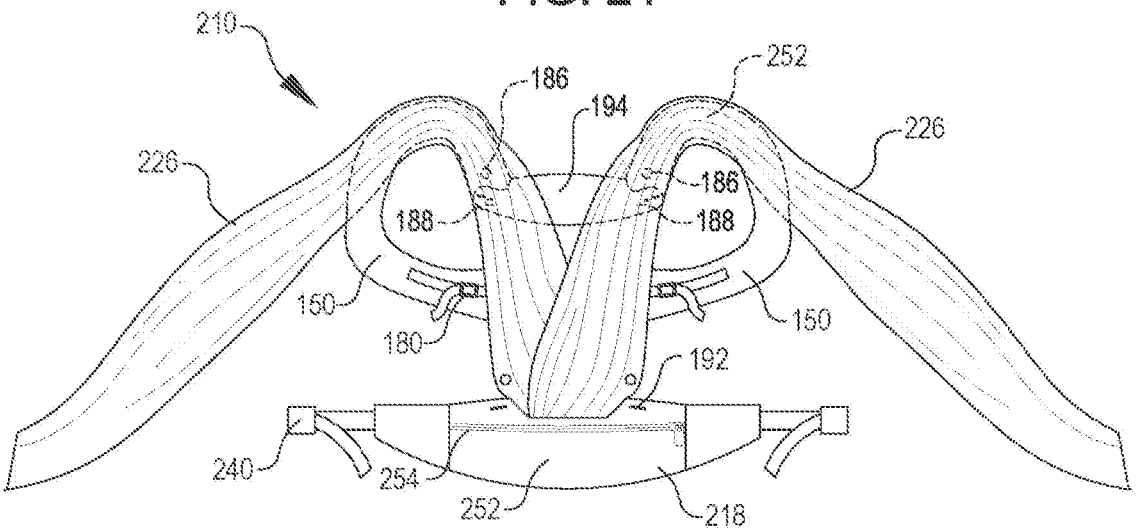
FIG. 21 is a front view of the baby carrier of FIG. 16 showing a folded headrest.

FIG. 21 shows a front view of a baby carrier 210 having a folded headrest 194. The headrest 194 is folded according to some of the examples described above. In addition, the headrest is shown with the tabs 188 unsecured from the securing devices 186 and the baby support portion 220 and/or the shoulder straps 150. The headrest 194 and the tabs 188 are positioned between the ties 226 and the baby support portion 220 as described herein. The ties 226 form passages 262 through which the shoulder straps 150 slidably pass. The passages 262 are formed by sewing lateral edges of the tie 226 together at a location at or near the upper edge of the baby support portion, the first end 202, extending for along the length of the tie 226 over a distance. The passage 262 may be less than an inch in length or may be several inches in length up to and exceeding 6 inches. The shoulder strap 150 passes through the passage 262 but is not fixed or coupled to the tie 226, allowing the shoulder strap 150 and the tie 226 to be adjusted and tightened or loosened independent of each other. For example, the shoulder strap 150 may be tightened or loosened to position the baby carrier 210 on the body of a caregiver 12 completely independent of the ties 226.

In some instances, the tie 226 may have bands attached to edges of the tie 226 forming one or more passages 262 through which the shoulder strap 150 passes. In some other examples, the opposite edges of the tie 226 may be sewn or connected together to form the passage 262 for the shoulder strap 150. The passage 262 defined by the tie 226 may be only a few inches in length, ranging from the width of a string or band at a fraction of an inch up to 6 or 8 inches. The slidable coupling of the ties 226 and the shoulder straps 150 may be accomplished with additional elements such as tubing formed from or attached to the ties 226 or with elastic members connected to both the shoulder strap 150 and the tie 226. The elastic member may keep the ties 226 and the shoulder straps 150 together or arranged correctly but also allow adjustment or movement relative to one another. Further examples of mechanisms or structures designed to achieve the slidable connection between the tie 226 and the shoulder strap 150 may involve the use of a channel and follower. For example, the tie 226 may have a reinforced channel formed in a portion of its length while the shoulder strap 150 has a button or other insert designed to fit in the channel and move in at least one direction.

The ties 226 may be loosened or tightened independently of the shoulder straps 150 to adjust a closeness of the baby 14 to the caregiver 12, when the ties 226 are tightened, the baby 14 will be pulled in closer to the caregiver 12 and when the ties 226 are loosened, the baby 14 will have additional space or area between the caregiver 12 and the baby carrier 210. The ties 226 may provide a reference for the caregiver 12 to guide how the baby carrier 210 is to be worn and the orientation of the baby carrier 210 before the caregiver 12 attempts to put on the baby carrier 210.

The ties 226 having a slidable relationship with the shoulder straps 150 not only guide a caregiver 12 in the correct orientation for wearing the baby carrier 210, but may also provide additional benefits while worn. For example, the shoulder straps 150 may be placed on the shoulders of a caregiver 12 and when the caregiver 12 wishes to secure the baby carrier 210 and a baby 14 in the baby carrier 210, the ties 226 that are slidably coupled to the shoulder straps 150 can be pulled tight and cross the back of the caregiver 12 (as shown in FIG. 11) before tying the free ends of the ties 226. With the ties 226 crossed in this manner, the baby carrier 210 and especially the shoulder straps 150 are secured on the shoulders of the caregiver 12 and the shoulder straps 150 are pulled toward the center of the caregiver's back. The slidable relationship between the ties 226 and the shoulder straps 150 not only ensures the shoulder straps 150 remain on the shoulders of the caregiver but also tightens the baby carrier 210 against the body of the caregiver 12 as described above. With the ties 226 slidably coupled, varying fits and tightness are available, and the caregiver can easily put on the baby carrier 210 and pull the ties 226 into place after putting on the shoulder straps 150.

Figure 22:
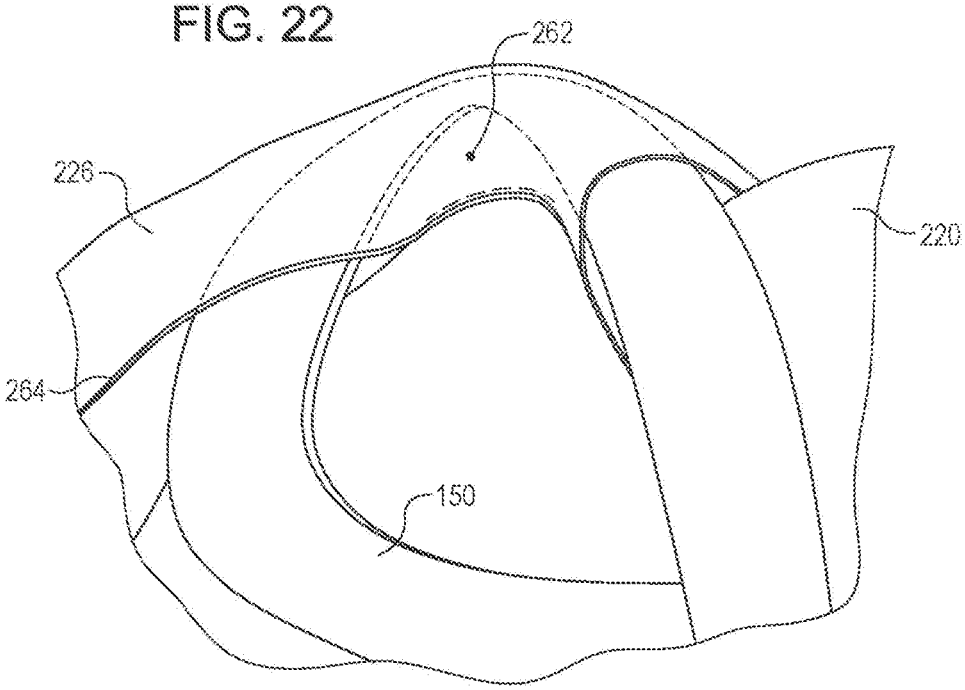
FIG. 22 is a detailed view of a shoulder strap of the baby carrier of FIG. 16 within a passage formed by a tie of the baby carrier.

FIG. 22 is a detail view of the shoulder strap 150, tie 226, and passage 262 according to some examples of the disclosure. The detail view displays one possible arrangement that allows the shoulder strap 150 and the tie 226 to slidably couple together. The tie 226 is attached at one end to the belt 218 and/or the baby support portion 220 (not shown in FIG. 21). The tie 226 is positioned along a similar direction with the shoulder strap 150 at the top of the baby support portion 220. The tie 226 has edges 264 along the length of the tie 226 from one end to the other. At a position near the top of the baby support portion 220, the tie edges 264 are stitched together to form a passage 262. The passage 262 extends along a portion of the length of the tie 226. The shoulder strap 150 is within the passage 262 formed by stitching the edges 264 of the tie 226 together. The shoulder strap 150 is therefore able to slide or move relative to the tie 226. However, the shoulder strap 150 and the tie 226 remain coupled together at the passage 262. The shoulder strap 150 and the tie 226 may be connected or coupled in other ways that allow for relative movement of the two components. For example, the tie 226 may include several retaining bands to contain the shoulder strap 150, the tie 226 may be joined to the shoulder strap 150 with an elastic band, or the tie 226 and/or shoulder strap 150 may include a slidable retention device to keep the two together while still allowing relative movement. An example of a slidable retention device includes one or more tubes stitched onto the shoulder strap 150 or tie 226 through which the other passes.

Figure 23:
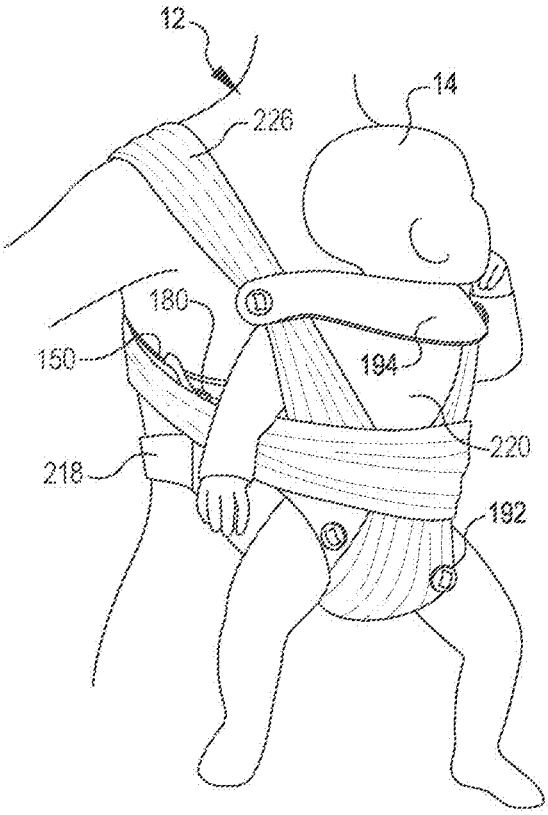
FIG. 23 is a front view of a caregiver wearing the baby carrier of FIG. 16 which supports a baby.

FIG. 23 shows a caregiver 12 wearing a baby carrier 210 with a baby 14 positioned in an outward facing orientation. The baby carrier 210 is shown in a narrow configuration, designed for a baby 14 facing outward to prevent bending or forcing the hips of the baby 14 to spread or splay outwards. The caregiver 12 is shown wearing the baby carrier 210 with the shoulder straps 150 and ties 226 over their shoulders. The shoulder straps 150 are shown with a length adjustment device 180 to lengthen or shorten the shoulder straps 150. The ties 226 pass over the shoulders of the caregiver 12 and cross behind the back of the caregiver 12 from one side of the caregiver's body to the other (not shown). The belt 218 is fastened around the waist of the caregiver 12. The baby support portion 220 is in a narrow configuration with the securing devices 192 not attached to the belt 218. The baby support portion 220 is stitched to the belt 218 but the additional width of attachment provided by the securing devices 192 is not used in this configuration. The result is that the baby's legs are not forced as far out to the side or splayed apart as much as they would be if the securing devices 192 were attached.

The baby carrier 210 also includes a foldable headrest 194. The headrest 194 is shown folded down to be out of the way of the baby's face. The headrest 194 includes securing devices shown as buttons in a button hole. Other methods of releasably securing the headrest are contemplated such as hook and loop fasteners, snaps, and elastic loops. The headrest 194 extends laterally and captures the ties 226 within the space between the baby support portion 220, the headrest 194, and the securing device 196. The tie 226 is kept tight and contained in a single location in this example rather than fanning or spreading out. This results in less loose material which may cause additional difficulty for a caregiver 12 to put on the baby carrier 210 correctly.

Figure 24:
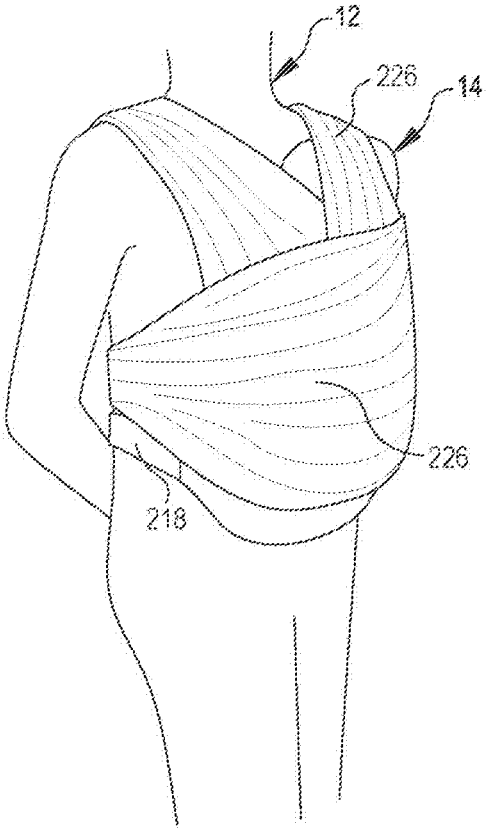
FIG. 24 is a front view of a caregiver wearing the baby carrier of FIG. 16 which supports a baby.

FIG. 24 shows a caregiver 12 with a baby 14 in a baby carrier 210 according to an example of the disclosure. The baby 14 is positioned inward facing and is nearly completely covered by the baby carrier 210. The ties 226 are routed from an attachment point with the belt 218 over the shoulders of the caregiver 12, crossing diagonally across the caregiver's back before wrapping around the front of the baby carrier 210 to be tied together. The ties 226 are not retained or constrained by any securing devices on the headrest 194 (not shown) and in FIG. 23 the ties 226 are pulled to extend their full width to provide coverage for the baby 14. The baby carrier 210 with the ties 226 extended to their full width as shown may provide privacy for the baby 14 or may also protect the baby 14 from sunlight, wind, cold, noise, or other disturbances.

FIG. 25 shows a front view of the baby carrier 210 highlighting the relative lengths of the ties 226 to the remainder of the baby carrier 210. In particular, the ties 226 are shown to be long enough to wrap fully around the body of a caregiver and tie together to secure the baby carrier 210. The ties 226 may have a length, from an attachment point with the belt in a range of about 70 to about 115 inches. From a location where the shoulder straps 150 are covered or contained by the ties 226 at the top of the shoulder straps 150, the ties may extend to around 60 inches in length. Other ranges or dimensions are envisioned and contemplated which will enable the ties 226 to wrap completely around a caregiver.

Figure 26:
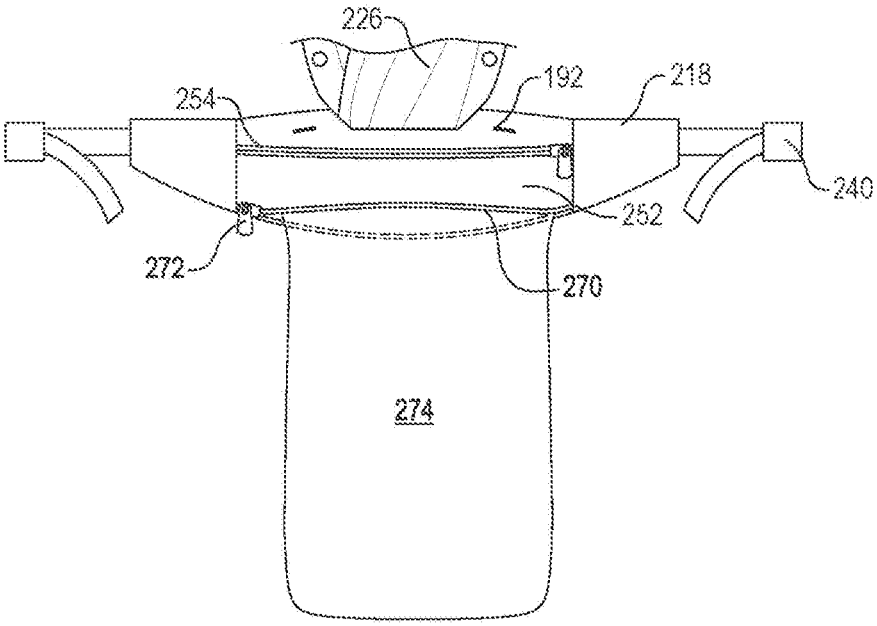
FIG. 26 is a detail view of a belt of the baby carrier of FIG. 16 containing a storage pocket and storage pouch.

FIG. 26 shows a more detailed view of belt 218. As previously described, belt 218 includes a pocket 252 for holding various supplies. Belt 218 may also include a storage pocket 270. The storage pocket 270 may be disposed at the bottom edge of the belt 218 as shown. In some other examples, the storage pocket may be disposed adjacent to the pocket 252 or in some other location on the baby carrier 210. The storage pocket 270 may be closed or secured with a zipper 272 disposed along the bottom edge of the belt 218. The zipper 272 may be a hidden zipper partially or totally covered by the fabric along the edge of the belt 218. In some examples, the zipper 272 may be replaced with other closure mechanisms such as hook and loop fasteners, button, snap buttons, or other releasable attachments. In some examples, the storage pocket 270 contains a pouch 274 which folds or pulls out of the storage pocket 270, but may still be attached within the storage pocket 270. The pouch 274 may be large enough for the baby carrier 210 to stow inside to contain the straps and ties for transportation or storage. To store the baby carrier 210, the entire body of the baby carrier 210 may be folded and/or stuffed inside of pouch 274.

Figure 27:
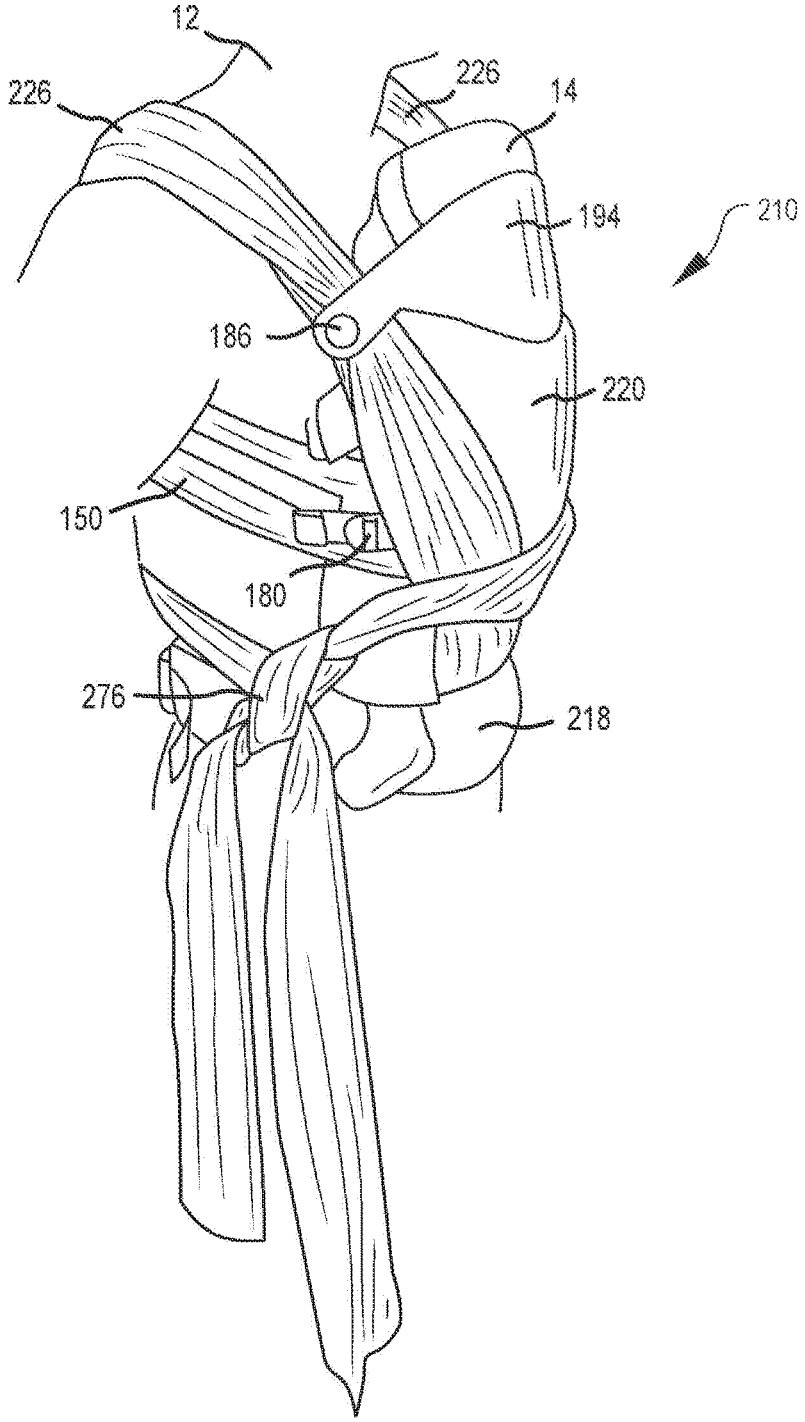
FIG. 27 is a front perspective view of a caregiver wearing the baby carrier of FIG. 16 which supports a baby.

FIG. 27 shows a front perspective view of a caregiver 12 wearing the baby carrier 210 with a baby 14 supported inside. The baby carrier 210 includes shoulder straps 150 over the shoulders of the caregiver 12 with ties 226 connected to the baby carrier 210 at the belt 218 and/or the baby support portion 220 as described above. The ties 226 lay on the shoulders of the caregiver 12 and cross each other on the back (not shown) of the caregiver 12 before being tied together in a knot 276. The shoulder straps 150 are adjustable using the length adjustment device 180 as described herein. The baby support portion 220 is coupled to the belt 218 at a bottom end and to the headrest 194 at an upper end.

Figure 28:
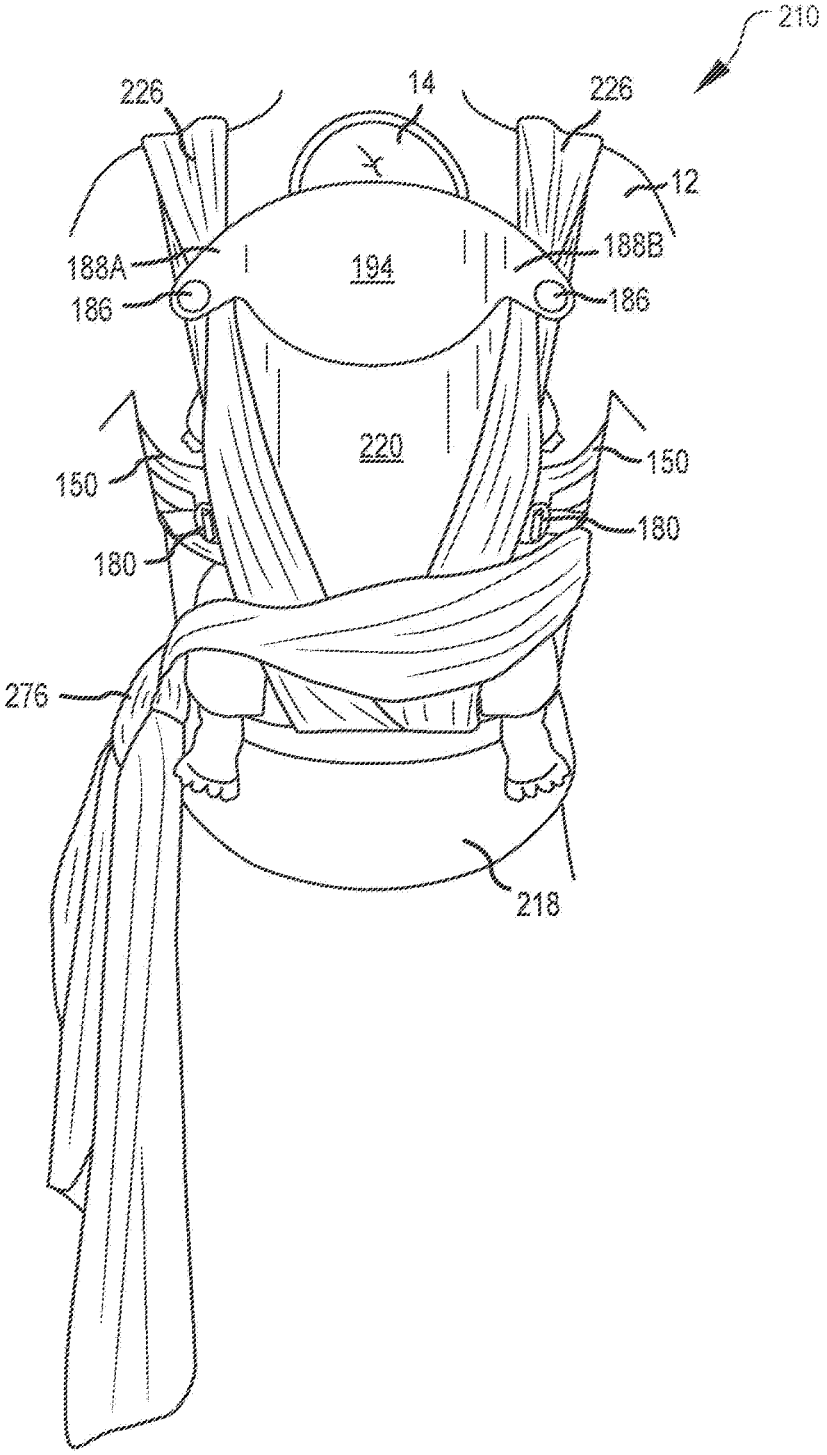
FIG. 28 is a front view of a caregiver wearing the baby carrier of FIG. 16 which supports a baby.

FIG. 28 shows a front view of a caregiver 12 wearing the baby carrier 210 which supports a baby 14. The shoulder straps 150 and ties 226 rest on the shoulders of the caregiver 12 as described above. The headrest 194 includes tabs 188A and 188B as well as securement 186. The belt 218 may have a curved upper and lower edge and include pockets as described herein.

Figure 29:
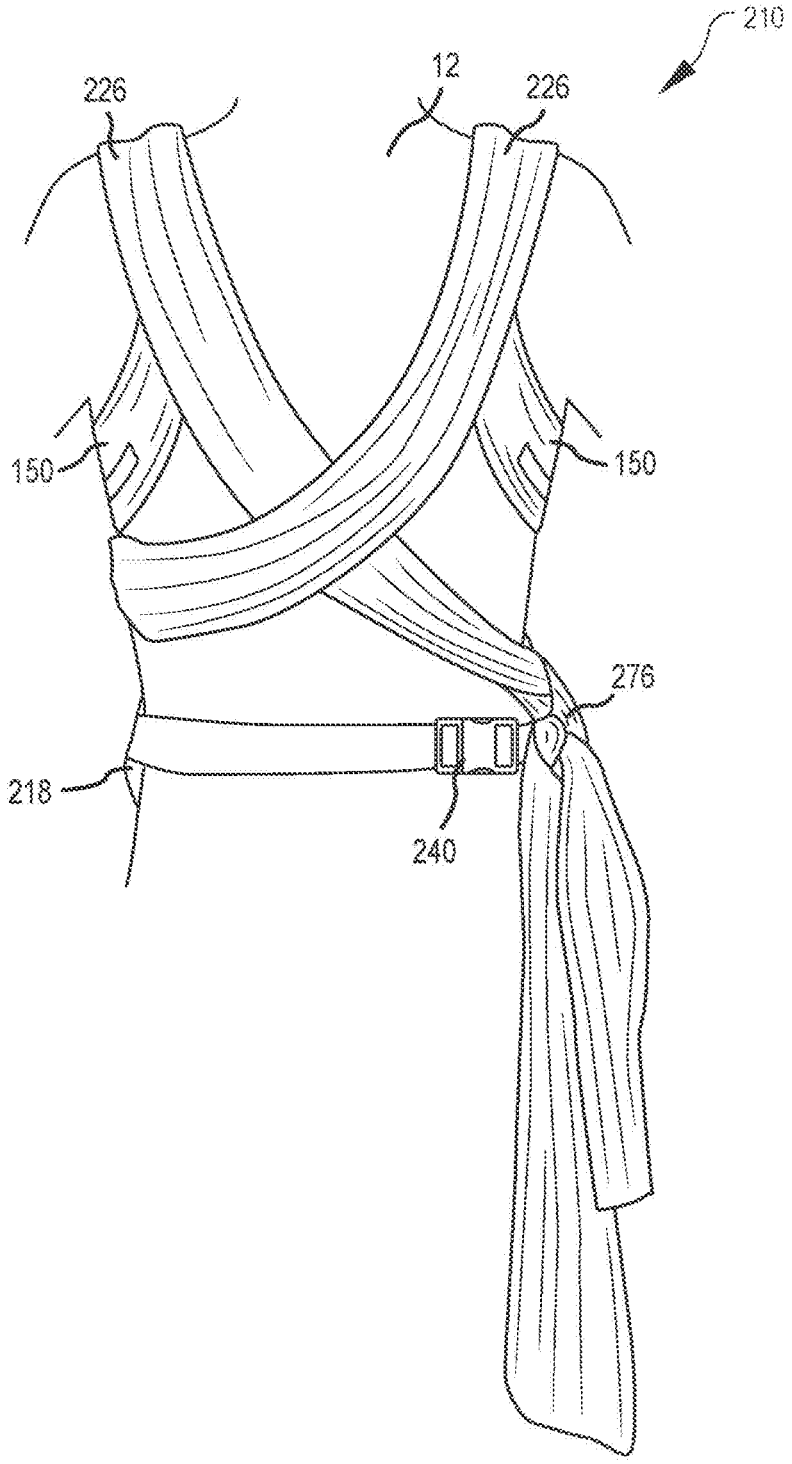
FIG. 29 is a rear view of a caregiver wearing the baby carrier of FIG. 16.

FIG. 29 shows a rear view of caregiver 12 wearing the baby carrier 210, with the crossing of the ties 226 shown in detail. The shoulder straps 150 rest on the shoulders of the caregiver 12 with the ties 226 over the top of the shoulder straps 150. The ties 226 cross each other and cross the body of the caregiver diagonally before wrapping around the torso of the caregiver 12 and being tied together in a knot 276. The knot is shown on the right side of the caregiver's body 12, but the knot may be tied on any side of the caregiver's body. The belt 218 includes a buckle system 240 as described above for securing the belt to the waist of the caregiver.

Figure 30:
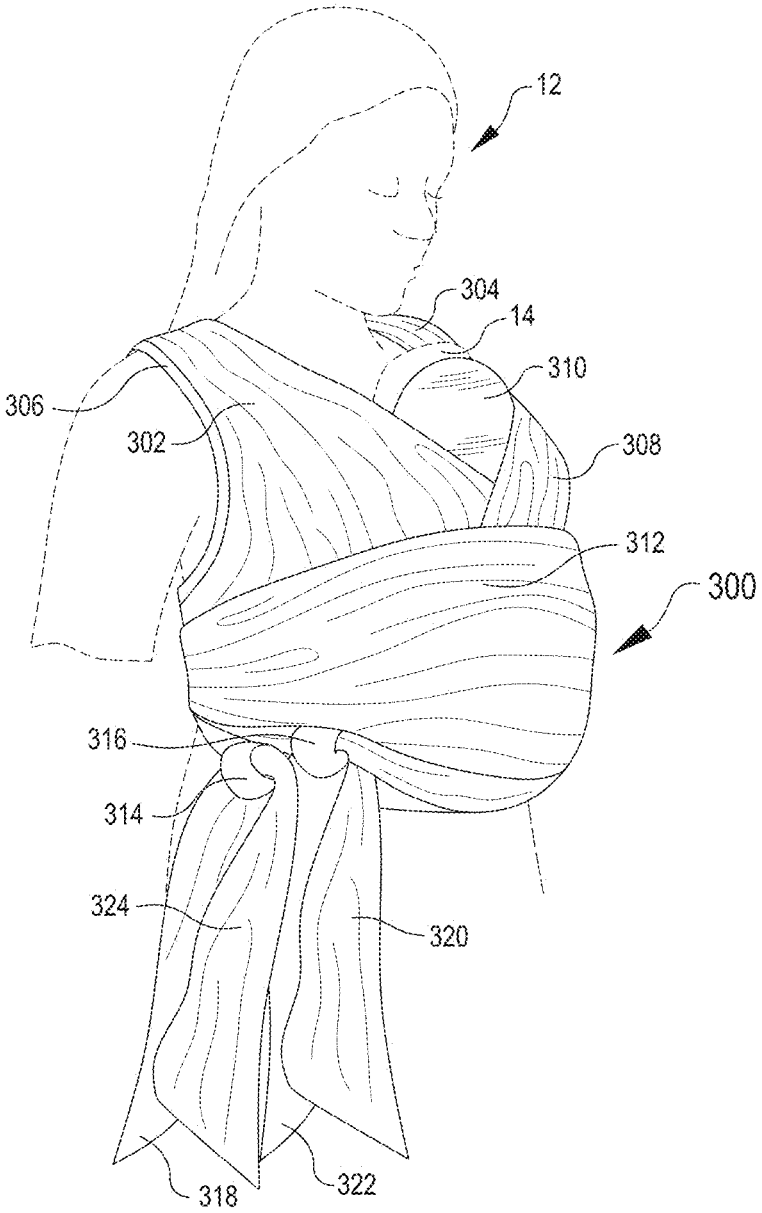
FIG. 30 is a front perspective view of a caregiver wearing a baby carrier having integral shoulder supports within the ties of the baby carrier.

FIG. 30 is a front perspective view of a caregiver 12 wearing a baby carrier 300 having integral shoulder supports within the ties 302 and 304 of the baby carrier 300. The baby carrier 300 may be similar to the baby carrier 10 and baby carrier 210 described herein, including variations thereof. The baby carrier 300 includes integral shoulder supports within the ties 302 and 304 such that the baby support 310 is coupled to a waist belt 326 and ties 302 and 304 without additional ties or straps. Tie 302 is shown with an opening 306 through which the arm of the caregiver 12 is inserted, allowing a portion of tie 302 to rest securely on top of the shoulder of the caregiver 12. The tie 302 is secure due to the ties 302 and 304 being tied together at knot 314 in addition to the stability offered by having the arm and shoulder of the caregiver 12 pass through the tie 302 itself, thereby securing the position of the tie 302 on the shoulder of the caregiver 12 and preventing movement of the tie 302 while the baby carrier 300 is worn. The ends 320 and 322 of ties 302 and 304 are tied together into the knot 314, though in some examples other securing means may be used to connect the ends of ties 302 and 304 including buckles, snaps, hook and loop fasteners, and other such releasable securing means that may be adjusted for length.

The ties 302 and 304, including around the openings 306A and 306B may be formed of a four way stretch material and may include one or more layers. The ties 302 and 304 may include two layers of stretchable material that can move relative to one another. Around the openings 306A and 306B there may be additional materials that define the perimeters of the openings, including other stretchable materials.

The baby support 310 may include a first material and a second material sewn together. The materials may each be spacer mesh material. In some examples the mesh materials may provide airflow and may prevent overheating for an infant in the baby carrier 300. In some examples additional materials, such as four way stretch materials may be included in the baby support 310. Some additional layers may provide soft supporting structure for the infant to rest against and to provide support for the infant when worn.

Figure 31:
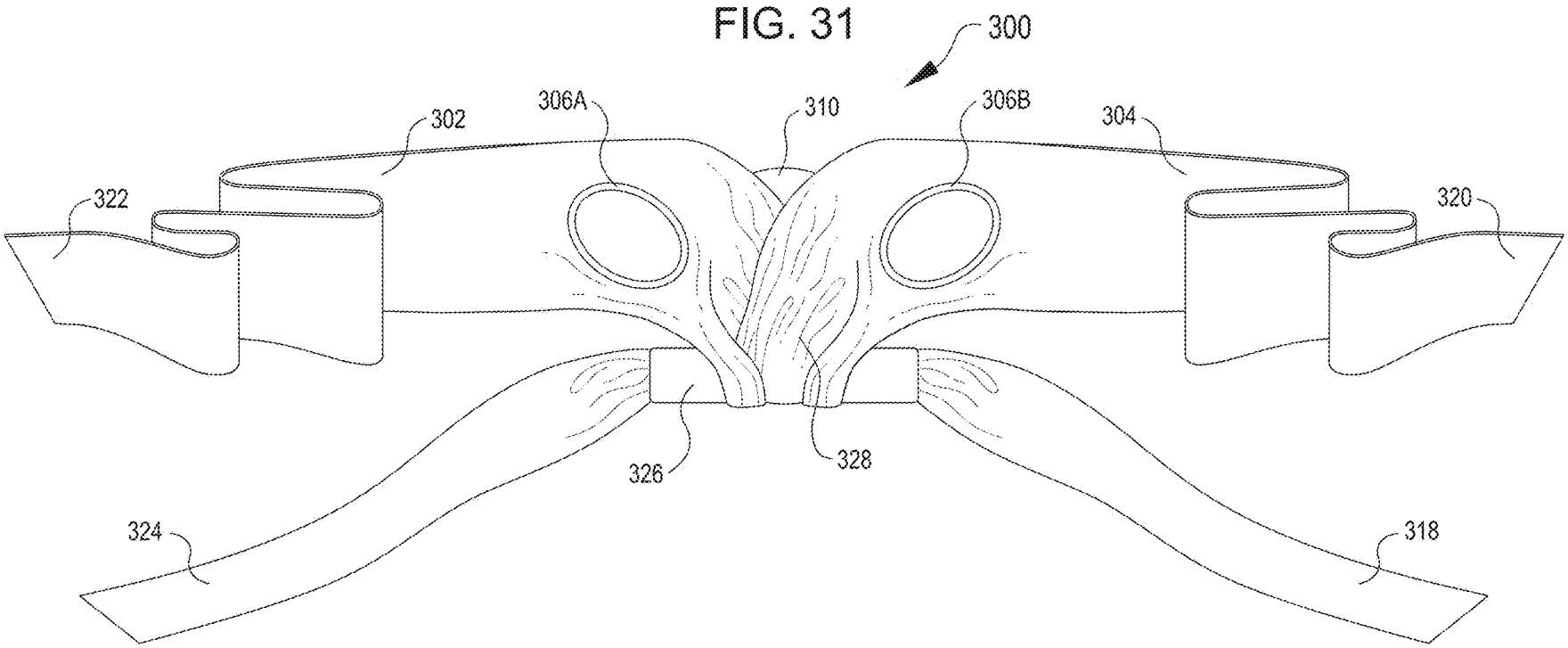
FIG. 31 is a front view of the baby carrier of FIG. 30, showing the integral shoulder supports within the ties.

The waist belt 326 may be similar to waist belts described herein and may include length adjustment devices or may include ties 318 and 324, such as shown in FIG. 31 that tie together at knot 316 to secure the waist belt around the waist of the caregiver 12. The waist belt 326 and the ties 318 and 324 may be formed of similar materials to other ties and belts described herein including four-way stretch materials, nylon, cotton, jersey knit, and other such suitable materials.

In some examples, the waist belt 326 may be formed of up to four or more layers. In some examples, the waist belt 326 may be formed of a layer of suede or faux suede, a first spacer mesh, a second spacer mesh, and a stretchable material such as a four way stretch material. The different layers may be combined in any possible orientation, subset of materials, and may include additional materials in some embodiments.

FIG. 31 is a front view of the baby carrier 300 of FIG. 30, showing the integral shoulder supports within the ties. The integral shoulder supports are formed as openings 306A and 306B in the ties 302 and 304. The openings 306A and 306B thereby split the ties 302 and 304 into upper straps that rest on the shoulder of the caregiver 12 and under-arm straps that rest underneath the arm of the caregiver 12. The openings 306A and 306 B are shown as round openings, having an oval-shape, though other shapes including circular, rectangular, geometric, irregular, and angular openings may be suitable. The openings 306A and 306B are shown as ovals having a major axis set at an angle of around forty-five degrees with respect to a horizontal axis (along the waist belt). In some examples the openings may be at a vertical, ninety degree, angle or a horizontal angle with respect to the horizontal axis. In some examples the openings may be along any other suitable angle. The openings may have a diameter, or effective diameter, in the case of non-circular openings, of between four and twelve inches. Different sizes of openings may accommodate larger shoulders and provide additional room for movement of the arms of caregiver 12 while wearing the baby carrier 300 while still ensuring that the fit around the shoulder is snug to support the weight of the baby carrier 300 on the shoulder.

The openings 306A and 306B rest comfortably around the shoulders of the caregiver 12 such that the ties 302 and 304 fit on the caregiver 12 similar to a t-shirt sleeve opening. The perimeter of the openings 306A and 306B may be reinforced with an additional material such as an elastic to maintain the shape of the opening over time or additional fabric to increase the wear resistance of the openings 306A and 306B, particularly under the arm of the caregiver 12, where the arm may rub against the perimeter of the openings. The perimeters of the openings may have seams or may not have seams, in some cases omitting a seam around the edge of the openings 306A and 306B may provide additional comfort benefits. The openings 306A and 306B are set laterally away from the center of the baby support 310, for example at a distance of six to eighteen inches from the center of the baby support 310 to the center of the openings 306A and 306B. The distance ensures that the shoulders of the caregiver 12 can comfortably fit within the openings 306A and 306B without excessive force required to stretch and get the shoulder through openings 306A and 306B.

The ties 302 and 304 taper from a first width at fixed ends 318 and 324 at or near the baby support 310 to a second width at the free ends 320 and 322. The ties 302 and 304 may have a greater width than ties 226, for example of FIG. 25, to accommodate the openings 306A and 306B. The openings 306A and 306B enable the baby carrier 300 to provide the benefits and comfort of the carrier 210 and also provides a simple and comfortable design that is easy for a caregiver to wear and support an infant.

Figure 32:
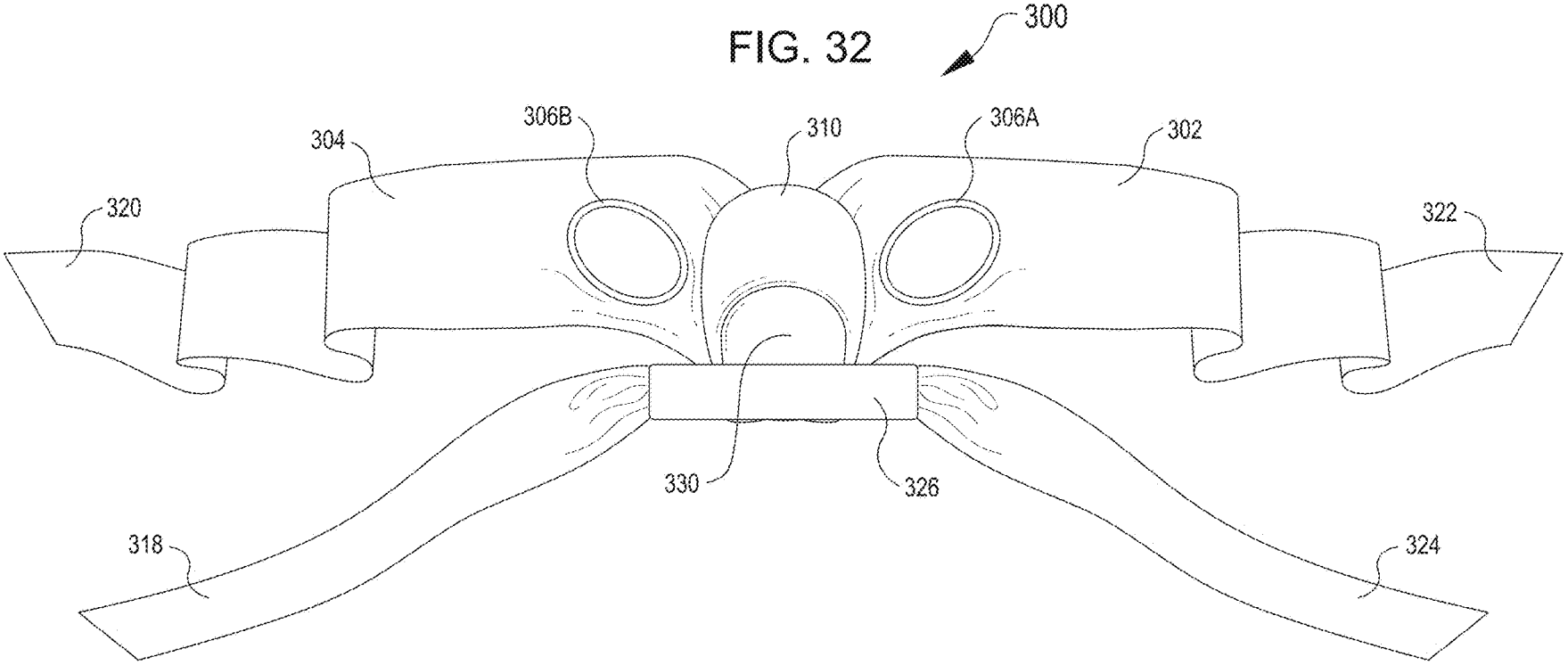
FIG. 32 is a rear view of the baby carrier of FIG. 30, showing an internal side of the baby carrier and a shaped baby support seat.

FIG. 32 is a rear view of the baby carrier 300 of FIG. 30, showing an internal side of the baby carrier 300 and a shaped baby support 310. The baby support 310 may include components described above, including the layers described with respect to FIG. 5, the configurable headrest 194, and other such features. In addition, the baby support 310 is contoured to include a concave shape on the inner surface of the baby support 310, the inner surface facing the caregiver 12 when wearing the baby carrier 300. The baby support 310 may define a bucket or seat shape to cradle the backside of an infant 14 within the carrier. The seat shape having a concave bucket-like shape may provide comfort benefits and additionally helps with positioning of the infant 14 as well as helping the infant 14 to remain in the correct position within the baby carrier 300.

Figure 33:
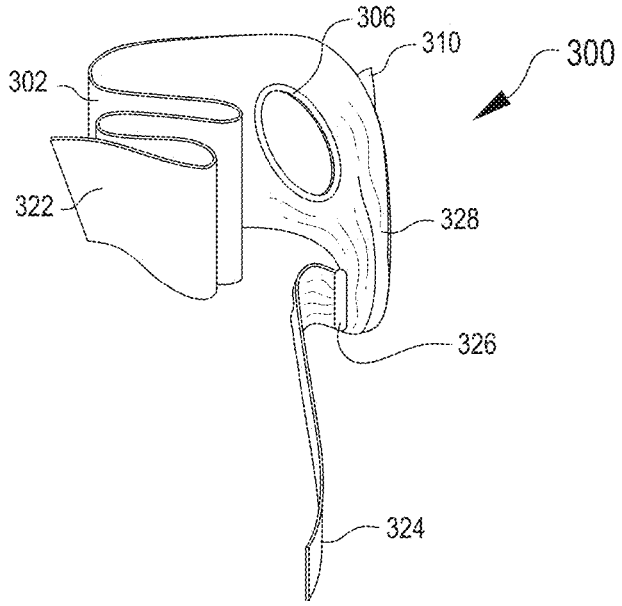
FIG. 33 is a side view of the baby carrier of FIG. 30, showing a side of the baby carrier and the curved shape of the baby support.
Figure 34:
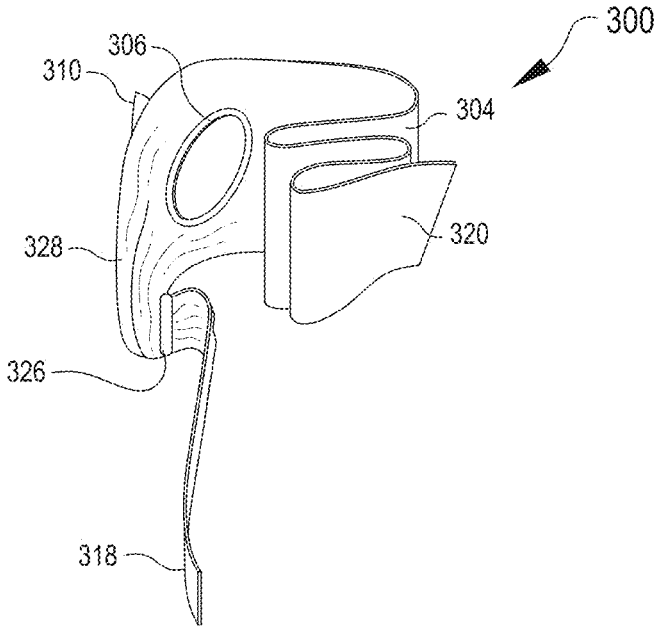
FIG. 34 is a side view of the baby carrier shown from the opposite side of FIG. 34.

FIGS. 33 and 34 show side views of the baby carrier 300 of FIG. 30, showing a side of the baby carrier 300 and the curved shape of the baby support 310. As described above with respect to FIG. 32, the baby support 310 may have a curved shape, concave on an inner surface of the baby support 310. The side views of FIGS. 33 and 34 show that the concave portion is positioned at or adjacent the bottom of the baby support 310, adjacent the waist belt 326 to provide a seat for the infant 14 to rest on.

Figure 35:
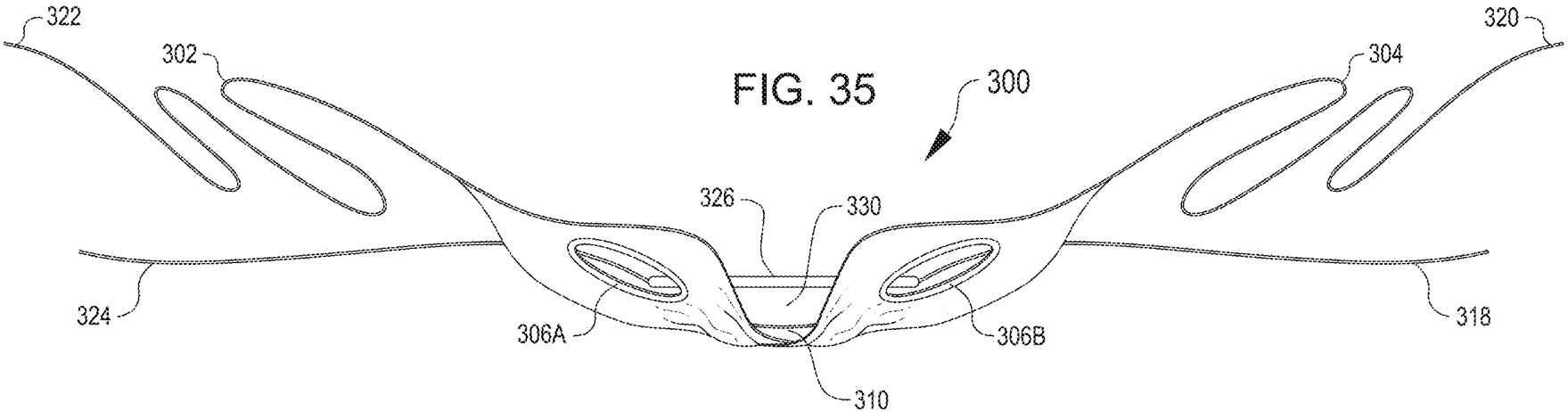
FIG. 35 is a top view of the baby carrier of FIG. 30 with integral shoulder supports within the ties.
Figure 36:
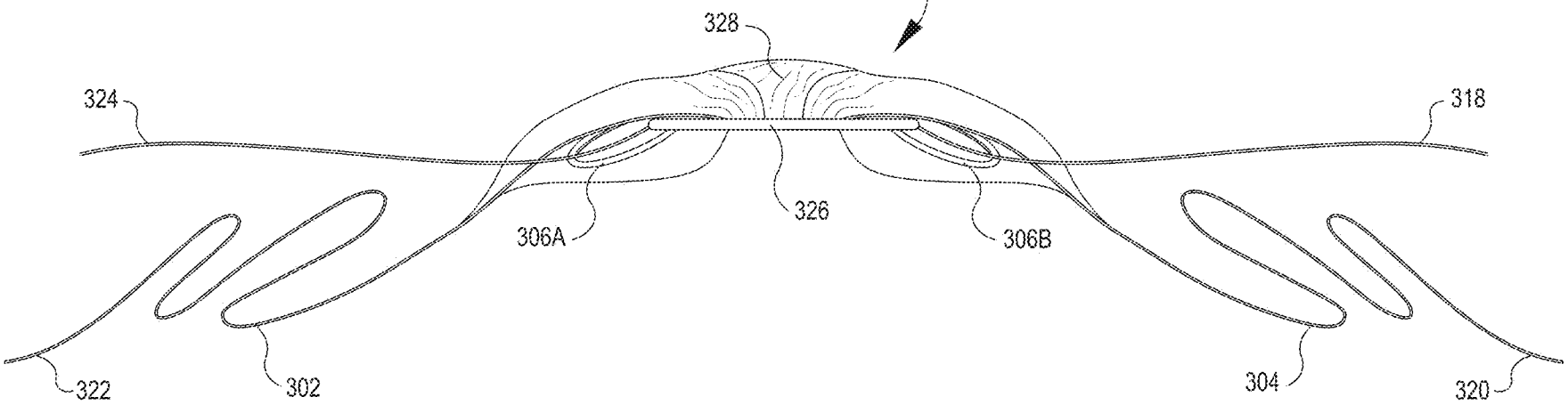
FIG. 36 is a bottom view of the baby carrier of FIG. 30, showing the bottom side opposite the view of FIG. 35.

FIGS. 35 and 36 show top and bottom views of the baby carrier 300 of FIG. 30 with integral shoulder supports within the ties. As illustrated, the ties are shown in a folded configuration, but may be of a varying length, as described above with respect to ties 216 and other such straps and ties described herein. In some examples, the ties 302 and 304 are long enough to wrap around the body of the caregiver 12 and tie in knot 316.

While the disclosure may be susceptible to various modifications and alternative forms, specific examples have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

What is claimed is:

1. A baby carrier, comprising:
a waist belt;
a baby support coupled to the waist belt that is configured to support at least a portion of a baby; and
a first tie and a second tie each operably coupled to the baby support at a secured end and wherein:
a free end of the first tie and the second tie permit the first tie and the second tie to be tied together to secure the baby carrier to a caregiver separately from the waist belt; and
the first tie and the second tie each define a perimeter of a respective first and second armhole, the first and second armholes positioned between the free end and the secured end and each armhole configured to receive an arm of the caregiver and enable the first tie and the second tie to rest against a shoulder of the caregiver when the baby carrier is secured to the caregiver.

2. The baby carrier of claim 1, wherein the first tie and the second tie each taper from a first width at the secured end to a second width at the free end of the first tie and the second tie.

3. The baby carrier of claim 1, wherein the perimeter of the first and second armhole are each entirely defined by the first tie or the second tie, respectively.

4. The baby carrier of claim 1, wherein the baby support is contoured to define a concave seat to receive the baby.

5. The baby carrier of claim 4, wherein the perimeter of the first arm and second armhole are each round and positioned adjacent the baby support at a middle region of the width of the first tie and the second tie, respectively.

6. A baby carrier, comprising:
a waist belt;
a baby support coupled to the waist belt; and
a first tie coupled to the waist belt and the baby support, the first tie having a first width adjacent the baby support and defining a first opening through the first tie, the first opening configured to receive a first arm of a caregiver when the baby carrier is secured to the caregiver;
a second tie coupled to the waist belt and the baby support, the second tie having a second width adjacent the baby support and defining a second opening through the second tie, the second opening configured to receive a second arm of the caregiver when the baby carrier is secured to the caregiver.

7. The baby carrier of claim 6, wherein the first tie and the second tie each taper from a first width at the secured end to a second width at a free end of the first tie and the second tie.

8. The baby carrier of claim 6, wherein the first tie and the second tie are each formed of a four-way stretch material.

9. The baby carrier of claim 6, wherein the baby support comprises a concave surface on an inner side of the baby support to provide a seat support when the baby is in the baby carrier and worn by the caregiver.

10. The baby carrier of claim 6, wherein the first opening and the second opening are each round and positioned adjacent the baby support at a middle region of the width of the first tie and the second tie, respectively.

11. The baby carrier of claim 6, wherein the first tie and the second tie are each configured to adjust a position of the baby support relative to the caregiver.

12. The baby carrier of claim 6, wherein the waist belt, the baby support, the first tie, and the second tie comprise a jersey knit fabric.

13. The baby carrier of claim 6, wherein the waist belt comprises a pocket, and wherein the pocket comprises a storage pouch configured to store the baby carrier inside a volume thereof.

14. A baby carrier, comprising:
a waist belt;
a baby support coupled to the waist belt;
a first tie and a second tie, each coupled at one end to the baby support, and wherein each of the first and the second ties define a passage through which an arm of a caregiver passes when the baby carrier is worn by a caregiver, the first tie and the second tie configured to be tied together to secure the baby carrier to a caregiver separately from the waist belt; and
a configurable headrest coupled to the baby support at an end opposite the waist belt, wherein the configurable headrest is configurable between:

an outward facing configuration wherein the configurable headrest is folded down to reduce a length of the baby support; and an inward facing configuration wherein the configurable headrest is extended to increase the length of the baby support.

15. The baby carrier of claim 14, wherein the first tie and the second tie each comprise jersey knit fabric.

* * * * *